US006722935B1

(12) United States Patent
Dunphy et al.

(10) Patent No.: US 6,722,935 B1
(45) Date of Patent: Apr. 20, 2004

(54) METHOD FOR MINIMIZING ZERO CURRENT SHIFT IN A FLAT PANEL DISPLAY

(75) Inventors: James C. Dunphy, San Jose, CA (US); Christopher J. Spindt, Menlo Park, CA (US)

(73) Assignee: Candescent Intellectual Property Services, Inc., Los Gatos, CA (US)

( * ) Notice: Subject to any disclaimer, the term of this patent is extended or adjusted under 35 U.S.C. 154(b) by 264 days.

(21) Appl. No.: 09/895,531

(22) Filed: Jun. 29, 2001

Related U.S. Application Data

(60) Continuation-in-part of application No. 09/566,697, filed on May 8, 2000, now Pat. No. 6,406,346, which is a division of application No. 09/053,247, filed on Mar. 31, 1998, now Pat. No. 6,107,731.

(51) Int. Cl.[7] ..... H01J 9/24
(52) U.S. Cl. ..... 445/24; 445/50; 313/292
(58) Field of Search ..... 445/3, 24, 25, 445/50, 51; 313/292, 495–497

(56) References Cited

U.S. PATENT DOCUMENTS 6,107,731 A * 8/2000 Spindt et al. ..... 313/495
6,403,209 B1 * 6/2002 Barton et al. ..... 428/307.7
6,406,346 B1 * 6/2002 Spindt et al. ..... 445/24
6,512,335 B1 * 1/2003 Dunphy et al. ..... 315/169.3
6,541,900 B1 * 4/2003 Ando ..... 313/292
6,541,905 B1 * 4/2003 Fushimi et al. ..... 313/495
6,566,794 B1 * 5/2003 Miyazaki ..... 313/292
6,583,549 B2 * 6/2003 Takenaka et al. ..... 313/422
6,583,553 B2 * 6/2003 Sasaguri ..... 313/495

* cited by examiner

*Primary Examiner*—Dean A. Reichard
*Assistant Examiner*—Adolfo Nino

(57) ABSTRACT

In a flat-panel display structure having a spacer with laterally segmented face electrodes, one embodiment of the present invention defines the length of the laterally segmented face electrode sections to minimize zero current shift variation in electron trajectories. Advantageously, the present embodiment of the invention prevents image quality degradation. In one embodiment, values for variation in the uniformity of and dicing tolerance are combined to calculate a design optimum for the length of laterally segmented face electrodes. Zero current shift variation from fluctuations in wall resistance falls off with the length of laterally segmented face electrodes. Zero current shift due to first order angular alignment during dicing varies linearly with the dashed electrode length. In one embodiment of the present invention, an optimal value is calculated by combining these effects to minimize zero current shift. Advantageously, in one embodiment, the electrode segments are individually testable.

16 Claims, 15 Drawing Sheets

METHOD FOR MINIMIZING ZERO CURRENT SHIFT IN A FLAT PANEL DISPLAY

RELATED US APPLICATION

This patent application is a continuation-in-part of co-pending U.S. patent application Ser. No. 09/566,697, filed on May 8, 2000 now U.S. Pat. No. 6,405,346, and entitled "FABRICATION OF FLAT-PANEL DISPLAY HAVING SPACER WITH LATERALLY SEGMENTED FACE ELECTRODES", by Christopher Spindt and John Field, and assigned to the assignee of the present invention, which is incorporated herein by reference and which is a divisional application of U.S. patent application Ser. No. 09/053,247, filed on Mar. 31, 1998, now U.S. Pat. No. 6,107,731, issued on Aug. 22, 2000 and entitled "Structure and Fabrication of Flat-Panel Display Having Spacer With Laterally Segmented Face Electrode," by Christopher Spindt and John Field, and assigned to the assignee of the present invention, which is incorporated herein by reference.

FIELD OF USE

This invention relates to flat-panel displays and, in particular, to the configuration of a spacer system utilized in a flat-panel display, especially one of the field emission type.

BACKGROUND ART

A flat-panel field emission display is a thin, flat display which presents an image on the display's viewing surface in response to electrons striking light-emissive material. The electrons can be generated by mechanisms such as field emission and thermionic emission. A flat-panel field emission display typically contains a faceplate (or frontplate) structure and a backplate (or baseplate) structure connected together through an annular outer wall. The resulting enclosure is held at a high vacuum. To prevent external forces such as air pressure from collapsing the display, one or more spacers are typically located between the plate structures inside the outer wall.

FIGS. 1 and 2, taken perpendicular to each other, schematically illustrate part of a conventional flat-panel field emission display such as that disclosed in Schmid et al, U.S. Pat. No. 5,675,212. The components of this conventional display include backplate structure 20, faceplate structure 22, and a group of spacers 24 situated between plate structures 20 and 22 for resisting external forces exerted on the display. Backplate structure 20 contains regions 26 that selectively emit electrons. Faceplate structure 22 contains elements 28 that emit light upon being struck by electrons emitted from electron-emissive regions 26. Each light-emissive element 28 is situated opposite a corresponding one of electron-emissive regions 26.

Each of spacers 24, one of which is fully labeled in FIGS. 1 and 2, consists of main spacer wall 30, end electrodes 32 and 34, a pair of face electrodes 36, and another pair of face electrodes 38. End electrodes 32 and 34 are situated on opposite ends of spacer wall 30 so as to contact plate structures 20 and 22. Face electrodes 36 form a continuous U-shaped electrode with end electrode 32. Face electrodes 38 form a continuous U-shaped electrode with end electrode 34.

It is desirable that spacers in a flat-panel field emission display not produce electrical effects which cause electrons to strike the display's faceplate structure at locations significantly different from where the electrons would strike the faceplate structure in the absence of the spacers. The net amount that the spacers cause electrons to be deflected sideways should be close to zero. Achieving this goal is especially challenging when, as occurs In the conventional display of FIGS. 1 and 2, the spacing between consecutive wall-shaped spacers is more than two electron-emissive regions. If spacers 24 cause net electron deflections, the net deflections of electrons emitted from regions 26 located different distances away from the nearest spacer 24 are typically different. This can lead to image degradation such as undesired features appearing on the display's viewing surface.

Face electrodes 36 and 38 are utilized to control the electric potential field along spacers 24 in order to reduce their net effect on the trajectories of electrons moving from regions 26 to elements 28. However, as discussed in Schmid et al, spacers 24 are typically made by a process in which large sheets of wall material having double-width strips of electrodes 36 and 38 formed on the sheets are mechanically cut along the centerlines of electrodes 36 and 38. Due to mechanical limitations in performing the cutting operation, the width of each face electrode 36 or 38 can vary along its length.

In turn, the variation in face-electrode width causes the electrical effect that spacers 24 have on the electron trajectories to vary along the spacer length. The net electron deflection resulting from spacers 24 thus varies along their length. Even if the net electron deflection is largely zero at one location along the spacer's length, the net electron deflection at other locations along the spacer's length can cause substantial image degradation. It is desirable to avoid image degradation that arises from width variations of face electrodes that contact end electrodes. However, attempts at correction of the distortion due to interference with intended electron trajectories meet with effects caused by construction imperfections.

Imperfections in the construction of the wall results include variations in wall resistance uniformity and dicing alignment tolerance. This causes a zero current shift variation, e.g., a variation in the electron beam along the wall due to improper electrical potential on the wall surface. Zero current shift variation causes image degradation due to visible distortion of a display generated by the beam.

The conventional approach to attempting to prevent zero current shift has been to apply wall coatings and install and connect separate electrodes. However, these conventional approaches are complex and expensive. Further, they have the effect of rendering testing for defects nearly impossible. Quality testing is an often crucial requirement in fabrication of flat panel displays. Interfering with defects testing is problematic.

What is needed is a method for minimizing zero current shift variation in a flat panel field emission display. What is also needed is a method of fabricating a flat panel field emission display which minimizes zero current shift distortion in electron beams and resultant image degradation. Further, what is needed is a method of fabricating flat panel field emission display which minimizes zero current shift distortion in electron beams and resultant image degradation, and which facilitates testing and failure analysis. Further still, what is needed is a method which achieves these advantages without undue complexity and expense.

DISCLOSURE OF THE INVENTION

In accordance with one embodiment of the invention, a segmented face electrode overlies a face of a main portion of a spacer situated between a pair of plate structures of a flat-panel display. The segmented face electrode is spaced apart from both plate structures, one of which provides the display's image, and also from any spacer end electrodes contacting the plate structures. The face electrode is segmented laterally. That is, the face electrode is divided into a plurality of electrode segments spaced apart from one another as viewed generally perpendicular to either plate structure.

The flat-panel display is normally a flat-panel field emission display in which the image-producing plate structure emits light in response to electrons emitted from the other plate structure. As electrons travel from the electron-emitting plate structure to the light-emitting plate structure, the laterally separated segments of the face electrode typically cause the electrons to be deflected in such a manner as to compensate for other electron deflection caused by the spacer. By suitably choosing the location and size of the electrode segments, the net electron deflection caused by the spacer can be quite small.

The segments of the face electrode normally reach electric potentials largely determined by resistive characteristics of the spacer. Although the potential along the spacer generally increases in going from the electron-emitting plate structure to the light-emitting plate structure, the potential is largely constant along each electrode segment. The effect of this constant potential produces the compensatory electron deflection.

Division of the face electrode into multiple laterally separated segments facilitates achieving appropriate compensatory electron deflection along the entire active-region length of the spacer, the spacer's length being measured laterally, generally parallel to the plate structures. In particular, the value of electric potential that each electrode segment needs to attain in order to cause the requisite amount of compensatory electron deflection varies with distance from the plate structures in approximately the same way that the resistive characteristics of the spacer cause the segment potential to vary with distance from the plate structures. Once the desired segment potential is established for one distance from the plate structures, the distance from each segment to the plate structures can vary somewhat without significantly affecting the amount of compensatory electron deflection.

In contrast, consider what would happen if (a) a non-segmented face electrode were substituted for the present segmented face electrode and (b) the non-segmented face electrode were placed in approximately the same position over the main spacer portion as the segmented face electrode. The entire non-segmented face electrode would be at substantially a single electric potential. If the non-segmented face electrode were tilted relative to the plate structure for some reason, e.g., due to fabrication misalignment, one vertical slice through the non-segmented face electrode might be at largely the correct potential. However, a vertical slice anywhere else through the non-segmented face electrode would normally be at a wrong potential, leading to a wrong amount of compensatory electron deflection. Segmentation of the face electrode in the present flat-panel display provides tolerance in positioning the electrode segments to achieve the desired compensatory electron deflection across substantially all the active-region length of the spacer, thereby overcoming the lack of positioning tolerance that would occur with a non-segmented face electrode.

The amount of compensatory electron deflection caused by each segment of the present face electrode depends on the segment's width. Accordingly, the widths of the electrode segments normally need to be controlled well.

In applying the invention's teachings to the fabrication of a flat-panel display, particularly one of the field emission type, a masking step is typically utilized in defining the widths of the segments of the face electrode. In general, better dimensional control can be achieved with a masking operation, especially photolithographic masking as is normally utilized to implement the masking step, than with a mechanical cutting operation as employed conventionally by Schmid et al to define the widths of the face electrodes in U.S. Pat. No. 5,675,212. The net electron deflection arising from the presence of a spacer can thus more uniformly be made closer to zero in the invention than in Schmid et al.

One embodiment of the present invention provides a method for minimizing zero current shift and its variation in a flat panel field emission display. The present invention also provides a method of fabricating a flat panel field emission display which minimizes zero current shift distortion in electron beams and resultant image degradation. Further, the present invention provides a method of fabricating flat panel field emission display which minimizes zero current shift distortion in electron beams and resultant image degradation, and which facilitates testing and quality control. Further still, the present invention provides a method which achieves these advantages, which is simple and inexpensive.

In one embodiment, the length of the segment electrodes is defined to be effective to minimize zero current shift variation. A component of zero current shift variation resulting from wall resistance variations is determined. Another component of zero current shift variation resulting from fabrication misalignment is also determined. Both components of zero current shift variation are combined in a specific manner, which is operated upon to define a length at which zero current shift variation is minimal.

In one embodiment, flat panel field emission displays are fabricated utilizing segment electrodes of the lengths determined to minimize zero current shift variation. In one embodiment, the segment electrodes are sufficiently long to allow individual electrical testing thereof. Importantly, fabrication of flat panel field emission displays with segment electrodes of the defined length for minimizing zero current shift adds neither undue complexity nor expense.

In one embodiment, individual electrical testing of segment electrodes is applied to promote quality assurance during fabrication. Conventionally, individual electrical testing of segment electrodes was precluded due to their small size and unmanageably large number. Importantly, in one embodiment, individual electrical testing of segment electrodes is applied to enable quality control.

BRIEF DESCRIPTION OF THE DRAWINGS

Conventional Art

Like reference symbols are employed in the drawings and in the description of the preferred embodiments to represent the same, or very similar, item or items.

DESCRIPTION OF THE PREFERRED EMBODIMENTS

Figure 1:
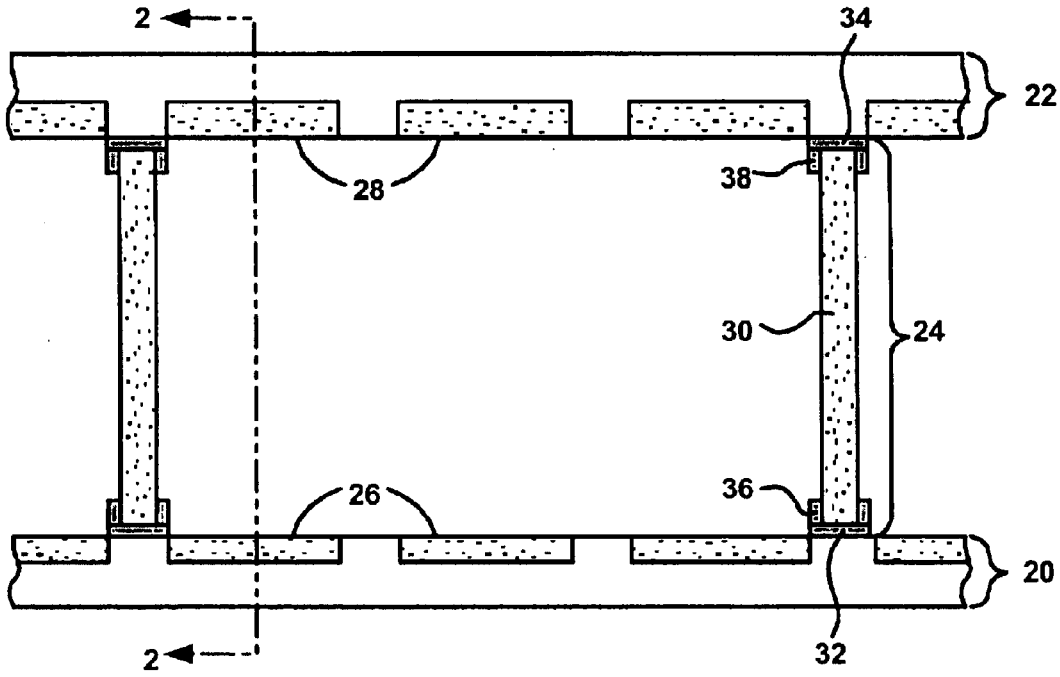
FIG. 1 PRIOR ART
FIGS. 1 and 2 are schematic cross-sectional side views of part of a conventional flat-panel field emission display. The cross section of FIG. 1 is taken through plane 1—1 in FIG. 2. The cross section of FIG. 2 is taken through plane 2—2 in FIG. 1.
Figure 2:
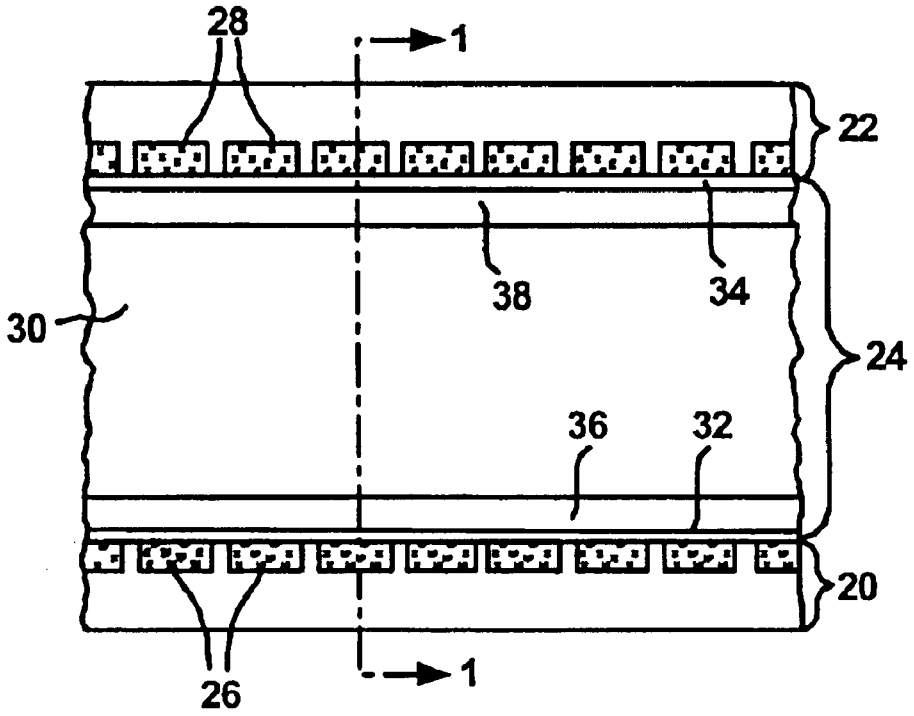
FIG. 2 PRIOR ART

Subject to the comments given in the following paragraph about certain types of thin coatings, the term "electrically resistive" generally applies here to an object, such as a plate or a main portion of a spacer, having a sheet resistance of $10^{10}$–$10^{13}$ ohms/sq. An object having a sheet resistance greater than $10^{13}$ ohms/sq. is generally characterized here as being "electrically insulating" (or "dielectric"). An object having a sheet resistance less than $10^{10}$ ohms/sq. is generally characterized here as being "electrically conductive".

A thin coating, whether a blanket coating or a patterned coating, formed over an electrically resistive main portion of a spacer is characterized here as "electrically resistive", "electrically insulating", or "electrically conductive" depending on the relationship between the sheet resistance of the coating and the sheet resistance of the main spacer portion. The coating is "electrically resistive" when its sheet resistance is from 10% to 10 times the sheet resistance of the underlying main spacer portion. The coating is "electrically insulating" when its sheet resistance is greater than 10 times the sheet resistance of the main spacer portion. The coating is "electrically conductive" when its sheet resistance is less than 10% of the sheet resistance of the main spacer portion.

The term "electrically non-insulating" applies to an object, including a thin coating, that is electrically resistive or electrically conductive. For example, an object having a sheet resistance of no more than $10^{13}$ ohms/sq. is generally characterized here as "electrically non-insulating". The term "electrically non-conductive" similarly applies to an object that is electrically resistive or electrically insulating. An object having a sheet resistance of at least $10^{10}$ ohms'sq. is generally characterized here as "electrically non-conductive". These electrical categories are determined at an electric field of no more than 10 volts/$\mu$m.

A spacer situated between a backplate structure and a faceplate structure of a flat panel field emission display as described below typically consists of (a) a main spacer portion, (b) a pair of end electrodes that respectively contact the backplate and faceplate structures, and (c) one or more face electrodes. The end electrodes extend along opposite ends (or end surfaces) of the main spacer portion. If these two opposite ends of the main spacer portion are also edges as arises when the main spacer portion is shaped like a wall, the end electrodes can also be termed edge electrodes. Each face electrode extends along a face (or face surface) of the main spacer portion and is normally spaced apart from both end electrodes.

The spacer has two electrical ends, referred to here generally as the backplate-side and faceplate-side electrical ends, in the immediate vicinities of where the end electrodes respectively contact the backplate and faceplate structures. The positions of the spacer's two electrical ends relative to the physical ends of the spacer at the two end electrodes are determined as follows for the case in which each face electrode is spaced apart from both end electrodes. Firstly, when an end electrode extends along substantially an entire end of the main spacer portion, the corresponding electrical end of the spacer occurs at that end electrode and thus is coincident with the corresponding physical end of the spacer. Secondly, should an end electrode extend along only part of an end of the main spacer portion, the corresponding electrical end of the spacer is moved beyond the physical end of the spacer by a resistively determined amount. Specifically, the spacer (including both the end and face electrodes) has a resistance approximately equal to that of a vertically wider (or taller) spacer having an end electrode that extends along the entire spacer end in question. The difference in physical width (or height) between the two spacers, i.e., the one having the abbreviated end electrode and the longer one having the full end electrode, is the distance by which the indicated electrical end of the spacer with the abbreviated end electrode is moved beyond the physical end of that spacer.

In some embodiments of a flat-panel display configured according to the invention, a face electrode may contact an end electrode. When this occurs, the corresponding electrical end of the spacer is moved up the spacer toward the other end electrode by a resistively determined amount. Should a face electrode contact an end electrode that extends along only part of the end of the main spacer portion, the corresponding electrical end of the spacer is either moved up the spacer toward the other end electrode, or beyond the spacer, by a resistively determined amount depending on various factors. The distance by which the electrical and physical ends of the spacer differ in these two cases is determined according to the technique described in the previous paragraph.

Figure 3:
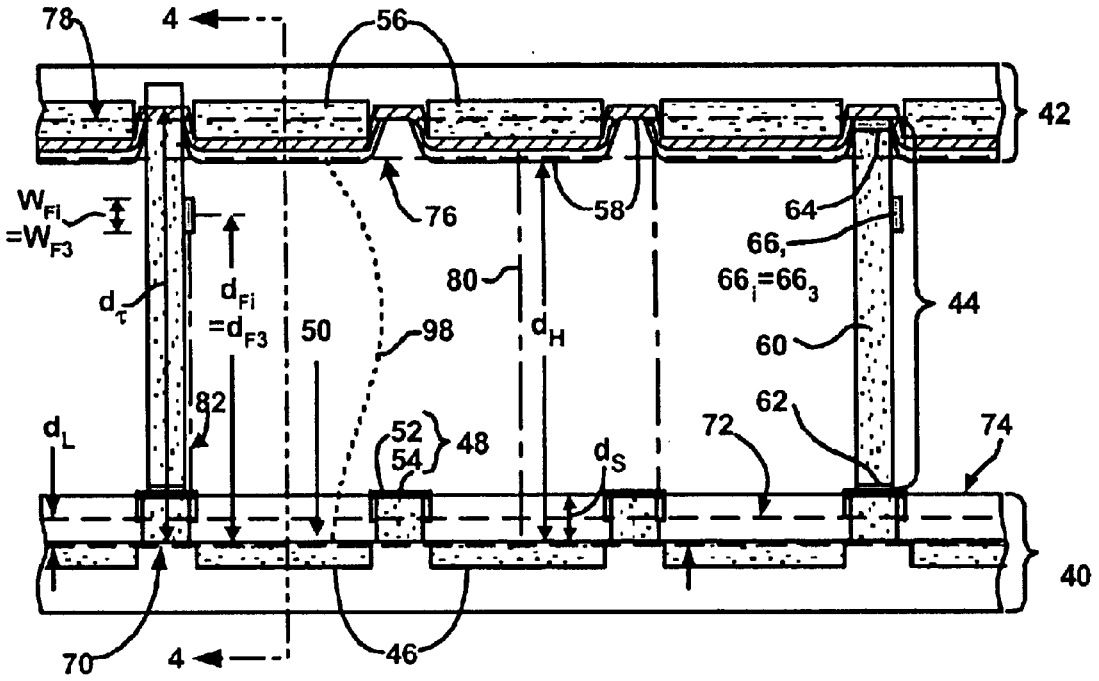
FIGS. 3 and 4 are cross-sectional side views of part of a flat-panel field emission display configured according to the invention. The cross section of FIG. 3 is taken through plane 3—3 in FIG. 4. The cross section of FIG. 4 is taken through plane 4—4 in FIG. 3.
Figure 4:
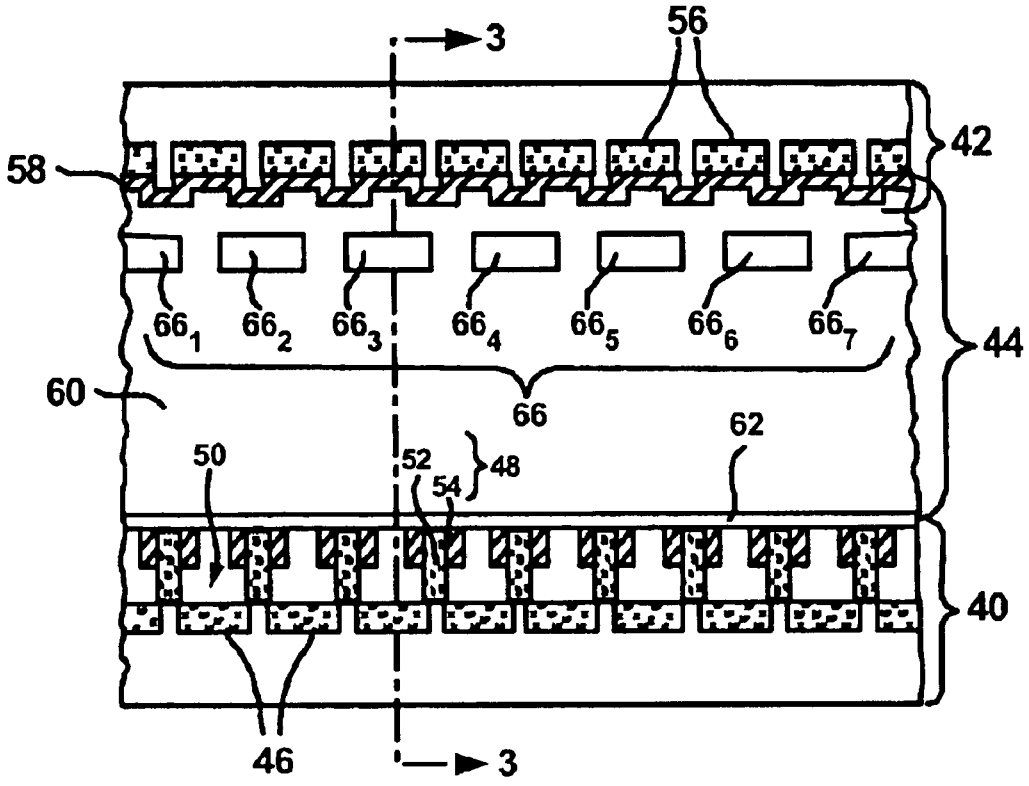

FIGS. 3 and 4, taken perpendicular to each other, schematically illustrate an active region part of a flat-panel field emission display having a spacer system configured according to the invention. The flat-panel field emission display of FIGS. 3 and 4 can serve as flat-panel television or a flat-panel video monitor suitable for a personal computer, a lap-top computer or a work station. In discussing the electrical capabilities of this flat-panel display, electric potentials are generally surface potentials, including work functions, rather than voltage supply potentials.

The flat-panel display of FIGS. 3 and 4 includes a backplate structure 40, a faceplate structure 42, and a spacer system situated between plate structures 40 and 42. The spacer system consists of a group of laterally separated spacers 44. In the example of FIGS. 3 and 4, each spacer 44 is roughly shaped like a wall.

The display of FIGS. 3 and 4 also includes an annular outer wall (not shown) situated between plate structures 40 and 42 to form a sealed enclosure in which spacers 44 are situated. The sealed enclosure is held at low pressure, typically $10^{-7}$ Torr or less. The spacer system formed with spacers 44 resists external forces, such as air pressure, exerted on the display and maintains a relatively uniform spacing between plate structures 40 and 42.

Backplate structure 40 contains an array of rows and columns of laterally separated regions 46 that selectively emit electrons in response to suitable control signals. Each electron-emissive region 46 typically consists of multiple electron-emissive elements. Regions 46 overlie a flat electrically insulating backplate (not separately shown). Further information on typical implementations of electron-emissive regions 46 is presented in Spindt et al, U.S. patent application Ser. No. 09/008,129, filed Jan. 16, 1998, now U.S. Pat. No. 6,049,165, the contents of which are incorporated by reference herein.

Backplate structure 40 also includes a primary structure 48 which is raised relative to electron-emissive regions 46. That is, primary structure 48 extends further away from the exterior surface of backplate structure 40 than regions 46. Structure 48 is typically configured laterally in a waffle-like pattern. Regions 46 are exposed through openings 50 in structure 48.

Primary structure 48 is typically a system that focuses electrons emitted from electron-emissive regions 46. For this purpose, electron-focusing system 48 consists of an electrically non-conductive base focusing structure 52 and an electrically conductive focus coating 48 that lies on top of base focusing structure 52 and extends onto its sidewalls. In the example of FIGS. 3 and 4, focus coating 48 extends only partway down the sidewalls of focusing structure 52 and is therefore spaced apart from electron-emissive regions 46. Alternatively, focus coating 54 can extend fully down the sidewalls of structure 52 provided that coating 54 is spaced apart from regions 46. In either case, focus coating 54 receives a low electron-focusing potential $V_L$, normally constant, during display operation.

Faceplate structure 42 contains an array of rows and columns of laterally separated light-emissive elements 56 respectively corresponding to electron-emissive regions 46. Light-emissive elements 56, typically phosphor, overlie a transparent electrically insulating faceplate (not separately shown). Upon being struck by electrons selectively emitted from electron-emissive regions 46, light-emissive regions 56 emit light to produce an image on the exterior surface of faceplate structure 42.

The flat-panel display of FIGS. 3 and 4 may be a black-and-white or color display. In the black-and-white case, each light-emissive region 56 and corresponding electron-emissive region 46 form a picture element (pixel). For a color display each light-emissive element 56 and corresponding electron-emissive region 46 form a sub-pixel. A color pixel consists of three adjoining sub-pixels, one for red, another for green, and the third for blue. The display has an active region defined by the lateral extent of the pixels.

Faceplate structure 42 further includes an electrical conductive anode layer 58. In the example of FIGS. 3 and 4, anode layer 58 is a light reflector that lies on top of light-emissive elements 56 and extends into the generally waffle-shaped region that laterally separate elements 56. This waffle-shaped region of faceplate structure 42 normally includes a "black" matrix that underlies anode layer 58. During display operation, anode layer 58 reflects back some of the rear-directed light to increase the image intensity. Alternatively, light-reflective anode layer 58 can be replaced with a transparent electrically conductive layer that underlies light-emissive elements 56. In either case, the anode layer receives a high anode potential $V_H$, normally constant, during display operation. Anode potential $V_H$ is typically 4–10 kilovolts and is typically approximately this amount above focus potential $V_L$.

Wall-shaped spacers 44 extend laterally in the row direction, i.e., along the rows of electron-emissive regions 46 or light-emissive elements 56. The row direction extends into the plane of FIG. 3 and horizontally in FIG. 4. The length of each spacer 44 is measured in the row direction. The width (or height) of each spacer 44 is measured vertically in FIGS. 3 and 4, i.e., from backplate structure 40 to faceplate structure 42, or vice versa. As indicated in FIG. 3, spacers 44 are laterally separated by more than two rows of regions 46 (or elements 56). In a typical implementation, thirty rows of regions 46 separate consecutive spacers 44.

Each spacer 44 consists of an electrically resistive main spacer portion 60, an electrically conductive backplate-side end electrode 62, an electrically conductive faceplate-side end electrode 64, and a laterally segmented electrically conductive face electrode 66. Main spacer portion 60 is typically shaped as a wall that extends at least across the active region of the display. The width (or height), measured vertically, of main spacer wall 60 is 0.3–2.0 mm, typically 1.25 mm; it may be, in one embodiment, as wide (high) as 5.0 mm. The thickness of main wall 60 is 40–100 $\mu$m, typically 50–60 $\mu$m. Main wall 60 consists of electrically resistive material and possibly electrically insulating material so distributed within wall 60 that the overall nature of wall 60 is electrically resistive from its top end to its bottom end.

Each main wall 60 can be internally configured in various ways. Main wall 60 can be formed as one layer or as a group of laminated layers. In a typical embodiment, wall 60 consists primarily of a wall-shaped substrate formed with electrically resistive material whose sheet resistance is relatively uniform at a given temperature such as standard temperature (0° C.). Alternatively, wall 60 can be formed as an electrically insulating wall-shaped substrate covered on both substrate faces with an electrically resistive coating of relatively uniform sheet resistance at a given temperature. The thickness of the resistive coating is typically in the vicinity of 0.1 $\mu$m. In either case, resistive material of wall 60 extends continuously along the entire width of wall 60.

Also, the resistive material of main wall 60 is typically covered on both faces with a thin electrically nonconductive coating that inhibits secondary emission of electrons. The secondary-emission-inhibiting coating typically consists of electrically resistive material. Specific examples of the constituency of main wall 16 are presented in Schmid et al, U.S. Pat. No. 5,675,212, also cited above, Spindt et al, U.S. Pat. No. 5,614,781, Spindt et al, U.S. Pat. No. 5,532,548, and Spindt et al, U.S. patent application Ser. No. 08/883,409, filed Jun. 26, 1997, now U.S. Pat. No. 5,872,424.

End electrodes 62 and 64 of each spacer 44 are situated on opposite ends of main spacer wall 60 and typically extend along the entirety of those two wall ends. Backplate-side end electrode 62 contacts backplate structure 40 along the top of focusing system 48, specifically the top surface of focus coating 54. Faceplate-side end electrode 64 contacts faceplate structure 42 along anode layer 58 in the waffle-like recession between light-emissive elements 56. The thickness of end electrodes 62 and 64 is 50 nm–1 $\mu$m, typically 100 nm. End electrodes 62 and 64 typically consist of metal such as aluminum, chromium, nickel, or a nickel-vanadium alloy.

Main spacer wall 60 of each spacer 44 has two opposing faces. Face electrode 66 lies on one of these faces spaced apart from end electrodes 62 and 64. Consequently, face electrode 66 is physically and electrically spaced apart from both of plate structures 40 and 42. Face electrode 66 extends laterally along the length of main wall 60. Face electrode 66 is at least approximately a quarter of the way from backplate structure 40 to backplate structure 42. That is, without having electrode 66 electrically touch faceplate structure 42, the minimum distance from backplate structure 40 to electrode 66 is approximately one fourth of the distance between plate structures 40 and 42. Normally, electrode 66 is somewhat closer to structure 42 than structure 40. The thickness of electrode 66 is 50 nm–1 $\mu$m, typically 100 nm. Electrode 66 typically consists of metal such as aluminum, chromium, nickel, or a nickel-vanadium alloy.

Focusing system 48 provides highly advantageous locations for spacers 44 to contact backplate structure 40. However, for the reasons discussed below, electrons emitted from electron-emissive regions 46, especially regions 46 directly adjacent to spacers 44, are deflected away from the nearest spacers 44 due to the way in which spacers 44 are arranged relative to plate structures 40 and 42, particularly backplate structure 40. The presence of face electrodes 66 causes the electrons to be deflected back towards the nearest spacers 44 to compensate for the deflection away from the nearest spacers 44. The net electron deflection is close to zero.

To accurately provide the compensatory electron deflection, face electrode 66 of each spacer 44 is divided into N electrode segments $\mathbf{66}_1, \mathbf{66}_2, \ldots \mathbf{66}_N$. FIG. 4 depicts seven electrode segments $\mathbf{66}_1$–$\mathbf{66}_7$, N thereby being at least 7. Electrode segments $\mathbf{66}_1$–$\mathbf{66}_N$ are spaced laterally apart from one another. That is, as viewed in the lateral direction perpendicular to main spacer wall 60 or as viewed in the vertical direction from backplate structure 40 to faceplate structure 42 (or vice versa), electrode segments $\mathbf{66}_1$–$\mathbf{66}_N$ are laterally separated. Segments $\mathbf{66}_1$–$\mathbf{66}_N$ are arranged generally in a line extending in the row direction parallel to the exterior surface of backplate structure 40. Electrode segments $\mathbf{66}_1$–$\mathbf{66}_N$ extend across substantially all the active-region length of wall 60.

Electrode segments $\mathbf{66}_1$–$\mathbf{66}_N$ of each spacer 44 are all typically of substantially the same size and shape. In the example of FIG. 3, segments $\mathbf{66}_1$–$\mathbf{66}_N$ are shown as equal-size rectangles. For the rectangular case, each segment $\mathbf{66}_i$ has a width $w_{Fi}$, measured vertically, of 50–500 $\mu$m, typically 70 $\mu$m, where i is an integer varying from 1 to N. Each segment $\mathbf{66}_i$ in the rectangular case has a length, measured laterally in the row direction, of 100 $\mu$m–2 mm, typically 300 $\mu$m. The lateral separation between consecutive ones of segments $\mathbf{66}_1$–$\mathbf{66}_N$ is 5–50 $\mu$m, typically 25 $\mu$m. Segments $\mathbf{66}_1$–$\mathbf{66}_N$ can have various other shapes such as ellipses (including circles), diamonds, trapezoids, and so on. Both the size and shape of segments $\mathbf{66}_1$–$\mathbf{66}_N$ can vary from segment $\mathbf{66}_i$ to segment $\mathbf{66}_i$ of each spacer 44.

Electrode segments $\mathbf{66}_1$–$\mathbf{66}_N$ "float" electrically. In other words, none of segments $\mathbf{66}_1$–$\mathbf{66}_N$ is directly connected to an external voltage source. Each segment $\mathbf{66}_i$ reaches an electric potential $V_{Fi}$ determined by resistive characteristics of spacer 44, particularly main spacer wall 60. Although segments $\mathbf{66}_1$–$\mathbf{66}_N$ in FIG. 4 are arranged generally in a line extending parallel to the exterior surface of backplate structure 40, the line may not be exactly straight. The line of segments $\mathbf{66}_1$–$\mathbf{66}_N$ may also be slanted slightly relative to the exterior backplate surface. As a consequence, potential $V_{Fi}$ achieved by one segment $\mathbf{66}_i$ may differ from potential $V_{Fi}$ achieved by another segment $\mathbf{66}_i$.

Electric potential $V_{Fi}$ of each electrode segment $\mathbf{66}_i$ of each spacer 44 normally penetrates largely through its main spacer wall 60 to the mirror-image location on the face of main wall 60 opposite the face having face electrode 66. Specifically, segment potential $V_{Fi}$ penetrates largely through wall 60 when it consists entirely of electrically resistive material. Due to the electric potential penetration through wall 60, it is usually unnecessary to provide a segmented face electrode on the opposite wall face at a location corresponding to electrode 66. Nonetheless, such an additional segmented face electrode can be provided on the opposite wall face. Also, when any intervening electrically insulating material is thick enough to significantly inhibit the electric potential penetration through wall 60, an additional segmented face electrode generally matching electrode 66 is normally placed on the wall face opposite that having electrode 66.

An understanding of the corrective electron-deflection function performed by segmented face electrode 66 involves the following electrical considerations. Referring to FIG. 3, the electron-emissive elements in regions 46 emit electrons generally from an emission-site plane 70 extending generally parallel to the exterior surface of backplate structure 40. Emission-site plane 70 is slightly below the upper surface of electron-emissive regions 46.

Backplate structure 40 has an electrical end located in a backplate-structure electrical-end plane 72 extending parallel to emission-site plane 70 at a distance $d_L$ away from emission-site-plane 70. The electrical end of backplate structure 40 is the approximate planar location at which the interior surface of structure 40 appears to terminate electrically as viewed from a long distance away. Local differences in the topography of the interior surface of structure 40 are electrically averaged out in determining its electrical end. As discussed below, the position of backplate-structure electrical-end plane 72 moves up and down slightly during display operation depending on the potentials applied to electron-emissive regions 46.

The top of focus coating 54 is at a distance $d_S$ above emission-site plane 70. Distance $d_S$ is normally 20–70 $\mu$m, typically 40–50 $\mu$m. Distance $d_L$ to backplate-structure electrical-end plane 72 is normally less than distance $d_S$. Distance $d_L$ is positive in the example of FIG. 3 in which electrical-end plane 72 overlies emission-site plane 70. In some embodiments, distance $d_L$ can be negative so that electrical-end plane 72 lies below emission-site plane 70.

Spacers 44 have backplate-side electrical end located in a backplate-side spacer electrical end plane 74 extending parallel to emission-site plane 70. Since backplate-side end electrodes 62 fully cover the backplate-side edges of main spacer walls 60, the backplate-side electrical ends of spacers 44 are coincident with their backplate-side physical ends at end electrodes 62. Hence, backplate-side spacer electrical-end plane 74 is located largely at distance $d_S$ above emission-site plane 70. Because distance $d_L$ is less than distance $d_S$, the backplate-side electrical end of each spacer 44 is situated above electrical-end plane 72 in which the electrical end of backplate structure 40 is located. This separation between backplate-structure electrical-end plane 72 and the backplate-side electrical end of each spacer 44 affects the potential field along spacers 44 near backplate structure 40 in such a way that electrons emitted from nearby electron-emissive regions 46 are initially deflected away from the nearest spacers 44.

In a similar manner, faceplate structure 42 has an electrical end located in a faceplate-structure electrical-end plane 76 extending parallel to emission-site plane 70 at a distance $d_H$ above plane 70. The electrical end of faceplate structure 42 is the approximate planar location at which the interior surface of structure 42 along anode layer 58 appears to terminate electrically as viewed from a long distance away.

Spacers 44 have faceplate-side electrical ends located in a faceplate-side spacer electrical-end plane 78 extending parallel to emission-site plane 70 at a distance $d_T$ above plane 70. With faceplate-side end electrodes 64 fully covering the faceplate-side edges of main spacer walls 60, the faceplate-side electrical ends of spacers 44 are coincident with their faceplate-side physical ends at end electrodes 64. Since spacers 44 extend into the waffle-like recession between light-emissive elements 56, the faceplate-side electrical end of each spacer 44 is spaced apart from faceplate-structure electrical-end plane 76.

More particularly, relative to backplate structure 40, the faceplate-side electrical ends of spacers 44 are situated above faceplate-structure electrical-end plane 76. The effect of this geometry is to cause electrons emitted from regions 46 to be deflected away from nearest spacers 44. Face electrodes 66 cause the potential field along spacers 44 to be perturbed in such a way as to compensate for electron deflection away from nearest spacers 44 caused by the faceplate-side electrical ends of spacers 44 being above faceplate-structure electrical-end plane 76 as well as electron deflection away from nearest spacers 44 caused by the backplate-side electrical ends of spacers 44 being located above backplate-structure electrical-end plane 72.

Alternatively, relative to backplate structure 40, the faceplate-side electrical ends of spacers 44 could be situated below faceplate-structure electrical-end plane 76. Such a configuration would cause electrons emitted from regions 46 to be deflected toward nearest spacers 44, thereby reducing the amount of compensatory electron deflection that face electrodes 66 need to cause.

Figure 5:
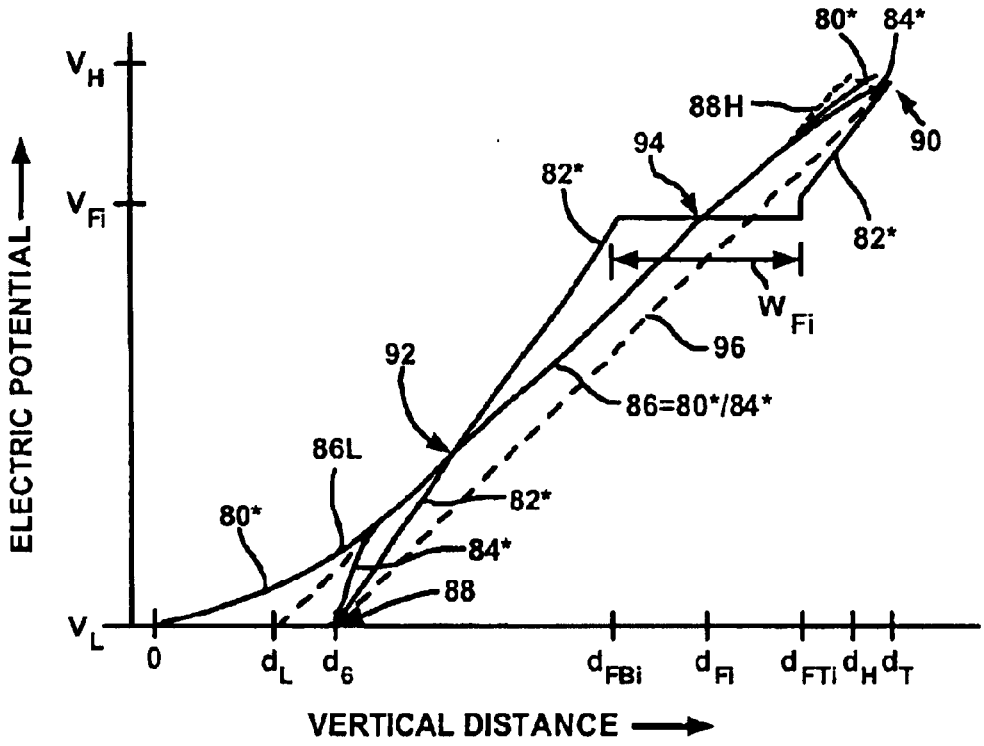
FIG. 5 is a graph of electric potential as a function of vertical distance at various locations in the flat-panel display of FIGS. 3 and 4.

FIG. 5 is a graph that qualitatively illustrates the electric potential field at various locations in the flat-panel display of FIG. 3. This graph is helpful in understanding how spacers 44, including segmented face electrodes 66, affect the movement of electrons from backplate structure 40 to faceplate structure 42. The graph of FIG. 5 is also helpful in understanding how distances $d_L$ and $d_H$ are determined and, consequently, how the electrical ends of plate structures 40 and 42 are determined.

More particularly, FIG. 5 illustrates how electric potential varies with distance along vertical lines 80, 82, and 84 in FIG. 3. In FIG. 5, vertical distance is zero at emission-site plane 70. Curves 80*, 82*, and 84* in FIG. 5 respectively represent the electric potentials along lines 80, 82, and 84. As discussed below, potential curves 80* and 84* converge in the space between plate structures 40 and 42. This convergence is represented by common potential curve 86 in FIG. 5.

Referring to FIG. 3, vertical line 80 originates along emission-site plane 70 at an electron-emissive region 46 separated by at least one row of regions 46 from the nearest spacer 44. Line 80 terminates at a portion of anode layer 58 overlying the corresponding light-emissive element 56. Accordingly, line 80 extends from a vertical distance of zero to a vertical distance of $d_H$.

Vertical line 82 extends along one face of main spacer portion 60 of left-hand spacer 44 in FIG. 3 from a top portion of focus coating 54 to a portion of anode layer 58 situated in the recession between light-emissive elements 56. In the example of FIG. 3, line 82 passes through face-electrode segment $\mathbf{66}_3$ of left-hand spacer 44. Alternatively, line 82 could extend along the opposite face of main spacer portion 60 of left-hand spacer 44. In that case, corresponding potential curve 82* would appear basically the same as shown in FIG. 5 except that the flat area corresponding, as indicated below, to face-electrode segment $\mathbf{66}_3$ would be rounded downward to the left and upward to the right.

Vertical line 84 originates at a top portion of focus coating 54 separated by at least one row of electron-emissive regions 46 from the nearest spacer 44, and terminates at a portion of anode layer 58 situated in the recession between light-emissive elements 56. Lateral-wise, lines 82 and 84 originate at points spaced largely equal lateral distances away from the edges of the underlying portions of focus coating 54. Each of lines 82 and 84 extends from a vertical distance of $d_S$ to a vertical distance of $d_T$.

The electrical end of backplate structure 40 at electrical-end plane 72 is defined with reference to an equipotential surface at $V_L$, the low focus potential applied to focus coating 54. For exemplary purposes in determining the location of the electrical end of backplate structure 40, the potential along plane 70 where regions 46 emit electrons is taken to be $V_L$ in FIG. 5. The equipotential surface at potential $V_L$ in the example of FIG. 5 thus extends through focus coating 54 and through the portions of plane 70 at electron-emissive regions 46.

With the foregoing in mind, electric potential 80* along vertical line 80 increases from low focus value $V_L$ at a vertical distance of zero to high anode value $V_H$ at a vertical distance between $d_H$ and $d_T$. Electric potential 84* along vertical line 84 increases from low value $V_L$ at distance $d_S$ to high value $V_H$ at distance $d_T$. Reference symbols 88 and 90 in FIG. 5 respectively indicate the end points of potential curve 84* at vertical distances $d_S$ and $d_T$. As the distance away from plate structures 40 and 42 increases, potentials 80* and 84* converge to potential 86 that varies linearly with increasing vertical distance, i.e., curve 86 is a straight line.

Dashed straight line 86L in FIG. 5 is an extrapolation of straight line 86 to low value $V_L$ on the horizontal axis. Straight line 86L reaches $V_L$ at distance $d_L$ thereby defining the electrical end of backplate structure 40. In essence, distance $d_L$ is the average distance electrically-to the backplate-side equipotential surface, primarily focus coating 54 here, at low potential $V_L$. During display operation, the portions of the $V_L$ equipotential surface at the locations of electron-emissive regions 46 move upward and downward depending on the potentials applied to each region 46. This movement of the $V_L$ equipotential surface causes the electrical end of backplate structure 40 to move slightly upward and downward during display operation, typically less than 1 $\mu$m. One primary reason for the movement of the electrical end of backplate structure 40 being so small here is that the ratio of distance $d_L$ to the column-direction spacing between consecutive regions 46 is (comparatively) large in the display of FIGS. 3 and 4.

Similarly, dashed straight line 86H in FIG. 5 is an extrapolation of straight line 86 upward to high value $V_H$. Straight line 86H reaches $V_H$ at distance $d_H$, thereby defining the electrical end of faceplate structure 42. Distance $d_H$ is the average distance electrically to the faceplate-side equipotential surface (anode layer 58) at high potential $V_H$. The electrical end of faceplate structure 42 is substantially stationary during display operation.

Each face-electrode segment $\mathbf{66}_i$ is located at an average vertical distance do above emission-site plane 70. In other words, distance $d_{Fi}$ is the vertical distance to half the width $w_{Fi}$ of segment $66_1$. FIG. 3 illustrates distance $d_{F3}$ and width $w_{F3}$ for segment $66_3$. Let $d_{FBi}$ and $d_{FTi}$ respectively represent the vertical distances from plane 70 to the bottom and top of segment $66_i$. Bottom distance $d_{FBi}$ then equals $d_{Fi}-w_{Fi}/2$. Top distance $d_{FTi}$ equals $d_{Fi}+w_{Fi}/2$.

As mentioned above, vertical line 82 passes through face-electrode segment $66_3$ of left-hand spacer 44. However, line 82 could as well be a vertical line passing through any other face-electrode segment $66_i$ of that spacer 44. For the sake of generality, potential 82* on line 82 is hereafter treated here as being the potential on a vertical line passing through any electrode segment $66_i$ of left-hand spacer 44.

Potential curve 82* originates from the same starting condition at point 88 as potential curve 84*, i.e., from low value $V_L$ at distance $d_S$. Except near backplate structure 40 and face-electrode segment $66_i$, potential 82* increases from this starting condition in a generally linear manner as a function of vertical distance to face-electrode potential $V_{Fi}$ at distance $d_{FBi}$. The approximately linear variation of potential 82* with vertical distance from $d_S$ to $d_{FBi}$ occurs because the sheet resistance of main spacer portion 60 is approximately constant along the width (or height) $d_T-d_S$ of spacer portion 60 at a given temperature. In going from low value $V_L$ to face-electrode potential $V_{Fi}$, curve 82* crosses the common portion 86 of curves 80* and 84* at a point 92.

Potential 82* stays substantially constant at $V_{Fi}$ across electrode segment width $w_{Fi}$ from distance $d_{FBi}$ to distance $d_{FTi}$. In so doing, curve 82* again crosses common portion 86 of curves 80* and 84*, this time at a point 94. As indicated in FIG. 5, point 94 occurs at distance $d_{Fi}$ approximately halfway across segment width $w_{Fi}$.

Except near face-electrode segment $66_i$ and faceplate structure 42, potential 82* increases in a generally linear manner from face-electrode potential $V_{Fi}$ at distance $d_{FTi}$ to high value $V_H$ at distance $d_T$, thereby terminating at the same ending condition at point 90 as potential 84*. The approximately linear variation of potential 82* with vertical distance from $d_{FTi}$ to $d_T$ occurs because the sheet resistance of main spacer portion 60 is approximately constant along its width at a given temperature. Except near electrode segment $66_i$ and plate structures 40 and 42, the slope of curve 82* across the $d_{FTi}-d_T$ region closely approximates the slope of curve 82* across the $d_S-d_{FBi}$ region.

When the electrical ends of a spacer, such as any of spacers 44, in a flat-panel field emission display are not respectively coincident with the electrical ends of the display's backplate and faceplate structures, the electric potential field along at least part of the surface of the spacer invariably differs from the electric potential field that would exist at the same location in free space between the backplate and faceplate structures, i.e., in the absence of the spacer. The trajectories of electrons moving from the backplate structure to the faceplate structure in the proximity of the spacer are affected differently by the so-modified potential field along the spacer then by the potential field that would exist at the same location in free space between the two plate structures. Consequently, the spacer affects the electron trajectories.

Spacers 44, including segmented face electrodes 66, affect the trajectories of electrons emitted from electron-emissive regions close to spacers 44 by compensating for undesired electron deflection that arises because the electrical ends of spacer 44 are spaced apart from the electrical ends of plate structures 40 and 42. In particular, the backplate-side electrical ends of spacers 44 are situated in electrical-end plane 74 at distance $d_S$ and thus are located above the electrical end of backplate structure 40 at distance $d_L$. The non-matching of the backplate-side electrical ends of spacers 44 to the electrical ends of backplate structure 40 generally causes the potential field along spacers 44 near structure 40 to be more negative (lower) in value than what would occur if the backplate-side electrical ends of spacer 44 were located in backplate-structure electrical end plane 72 and thereby matched to the electrical end of structure 40. As a result, electrons emitted from electron-emissive regions 46 close to spacers 44 are initially deflected away from the nearest spacers 44. Face electrodes 66 compensate for these initial undesired electron deflections by causing the electrons to be deflected back towards the nearest spacers 44.

Similarly, relative to backplate structure 40, the faceplate-side electrical ends of spacers 44 are situated in electrical-end plane 78 at distance $d_T$ and thus are located above faceplate-structure electrical-end plane 76 at distance $d_H$. The non-matching of the faceplate-side electrical ends of spacers 44 to the electrical end of faceplate structure 42 causes the potential field along spacers 44 near structure 42 to be more negative in value than what would occur if the faceplate-side electrical ends of spacers 44 were located in plane 76 and thus matched to the electrical end of structure 42. This causes electrons emitted from regions 46 to be deflected away from nearest spacers 44. Face electrodes 66 also compensate for this undesired electron deflection by causing electron deflection back towards the nearest spacers 44.

Face electrode 66 of each spacer 44 provides the deflection compensation in the following manner. As mentioned above, potential curves 82* and 84* originate from the same condition at point 88 and terminate at the same condition at point 90. This occurs because vertical lines 82 and 84 originate at corresponding locations relative to the top of focus coating 54. In effect, curve 84* represents the potential that would exist along line 82 in free space between plate structures 40 and 42, i.e., in the absence of spacers 44.

With anode potential $V_H$ exceeding the potential along emission-site plane 70, electrons emitted by electron-emissive regions 46 accelerate in traveling from backplate structure 40 to faceplate structure 42. Hence, the emitted electrons move faster near faceplate structure 42 than near backplate structure 40. Slower moving electrons are attracted or repelled more in response to the potential field near spacers 44 than faster moving electrons.

If face electrodes 66 were absent from spacers 44, the resulting potential along vertical line 82 next to so-modified left-hand spacer 44 in FIG. 3 would vary from point 88 to point 90 in FIG. 5 in an approximately linear manner with increasing vertical distance as represented by straight dashed line 96 in FIG. 5. In the illustrated example, electric potential 96 is always more negative in value than electric potential 84* (except at end points 88 and 90). In the absence of face electrodes 66, the potential at the surface of so-modified left-hand spacer 44 would cause electrons emitted from nearby electron-emissive regions 46, especially the two regions 46 nearest left-hand spacer 44, to be deflected away from it. This would occur even if the faceplate side of the display were modified so that curve 96 crosses curve 84* at a vertical distance corresponding to a point in the vicinity of one quarter of the way (or more) up the height of left-hand spacer 44.

With face electrodes 66 present, curve 82* crosses curve 84* at points 92 and 94. Between points 88 and 92, potential 82* is more negative in value than potential 84*. Consequently, electrons emitted from nearby electron emissive regions 46, especially the two regions 46 nearest to left-hand spacer 44, are deflected away from that spacer 44 due to the potential field experienced in traveling from the vertical distance at point 88 to the vertical distance at point 92. Although potential 82* is more negative in value than potential 84*, potential 82* is relatively close to potential 84*. The electron deflection away from left-hand spacer 44 due to the potential field in the lower region demarcated by points 88 and 92 is thus relatively small.

Between points 92 and 94, potential 82* is more positive (higher) in value than potential 84*, here represented by common potential 86. The electrons emitted from nearby electron-emissive regions 46 thereby undergo corrective electron deflections towards left-hand spacer 44 due to the potential field experienced in traveling from the vertical distance at point 92 to the vertical distance at point 94. As FIG. 5 illustrates, the area between curves 82* and 84* in the intermediate region demarcated by points 88 and 92 is considerably greater than the area between curves 84* and 82 in the lower region demarcated by points 88 and 92. Even though electrons travel faster in the intermediate region than in the lower region, the electron deflection towards left-hand spacer 44 due to the potential field in the intermediate region is significantly greater than the electron deflection away from that spacer 44 due to the potential field in the lower region. The magnitude of the area between curves 82* and 84* in the intermediate region, and thus the magnitude of the corrective electron deflection towards left-hand spacer 44, is determined by width $w_{Fi}$ of each face-electrode segment $\mathbf{66}_i$ of that spacer 44.

Between points 94 and 90, potential 82* is again more negative in value than potential 84*. Consequently, electrons emitted from nearby electron-emissive region 46 are deflected away from left-hand spacer 44 due to the potential field experienced in traveling from the vertical distance at point 94 to the vertical distance at point 90. The electrons reach their greatest velocity in the upper region demarcated by points 94 and 90, and thus are less affected by unit changes in potential 82* in the upper region than by unit changes in potential 82* in the intermediate region demarcated by points 92 and 94. With the mean value of face-electrodes segment width $w_{Fi}$ exceeding some specified minimum value and with each face-electrode-segment $\mathbf{66}_i$ being located at least approximately one fourth of the distance from backplate structure 40 to faceplate structure 42, the net result is that face electrode 66 causes electrons emitted from nearby electron-emissive regions 46 to be deflected towards left-hand spacer 44.

By appropriately choosing suitable mean values for segment widths $w_{Fi}$ and average segment distances $d_{Fi}$, the electron deflections toward spacers 44 correct for the undesired electron deflections away from spacers 44 due to the backplate-side electrical ends of spacers 44 being above the electrical end of backplate structure 40 and due to the faceplate-side electrical ends of spacers 44 being above the electrical end of faceplate structure 42. Curved dotted line 98 in FIG. 3 illustrates the trajectory of a typical electron emitted from one of the electron-emissive regions nearest to left-hand spacer 44. As electron trajectory 98 indicates, the initial and final electron deflections away from left-hand spacer 44 are corrected by an intermediate deflection towards that spacer 44 so that the net electron deflection is close to zero.

The magnitude of the compensatory electron deflection caused by each face-electrode segment $\mathbf{66}_i$ depends on segment width $w_{Fi}$ and segment potential $V_{Fi}$. The magnitude of the particular $V_{Fi}$ value that each electrode segment $\mathbf{66}_i$ needs to be at in order to achieve the right amount of corrective electron deflection generally increases with increasing segment distance $d_{Fi}$.

As mentioned above, the resistive characteristics of spacers 44 determine face-electrode segment potentials $V_{Fi}$. In particular, the magnitude of segment potential $V_{Fi}$ for each spacer 44 increases with increasing segment distance $d_{Fi}$, and vice versa. Importantly, the rate at which the resistive characteristics of each spacer 44 cause its $V_{Fi}$ magnitude to increase with increasing vertical distance is approximately the same as the rate at which the $V_{Fi}$ magnitude needs to increase with vertical distance to achieve the right amount of compensatory electron deflection. When the $V_{Fi}$ magnitude needed to achieve a desired compensatory electron deflection is determined for one selected value of distance $d_{Fi}$, the amount of compensatory electron deflection caused by electrode segment $\mathbf{66}_i$ varies relatively slowly as distance $d_{Fi}$ is varied upward and downward from the selected $d_{Fi}$ value.

The value of segment potential $V_{Fi}$ needed to achieve a specific compensatory electron deflection can vary along the length, measured laterally, of electrode segment $\mathbf{66}_i$ if it is tilted. Although such tilting can lead to a compensation error along the length of a tilted segment $\mathbf{66}_i$, the compensation error can be made quite small by making electrode segments $\mathbf{66}_i$ suitably short.

Importantly, the relative insensitivity of the deflection compensation to segment distance $d_{Fi}$ means that different ones of electrode segments $\mathbf{66}_1$–$\mathbf{66}_N$ can be at different $d_{Fi}$ values without significantly affecting the magnitude of the deflection compensation along the length of face electrode 66. While segments $\mathbf{66}_1$–$\mathbf{66}_N$ are typically arranged in a straight line, each face electrode 66 can be tilted or curved in various ways.

The flat-panel display of FIGS. 3 and 4 is manufactured in the following manner. Plate structures 40 and 42 and the outer wall (not shown) which laterally encloses spacers 44 and connects plate structures 40 and 42 together are separately manufactured. Spacers 44 are also separately manufactured. Components 40, 42, and 44 and the outer wall are assembled in such a way that the pressure inside the sealed display is quite low, normally no more than $10^{-7}$ Torr. In assembling the display, spacers 44 are inserted between plate structures 40 and 42 such that the backplate-side and faceplate-side ends of each spacer 44 respectively contact focus coating 54 and anode layer 58 at the desired locations.

Spacers 44 are normally fabricated by a process in which a masking operation is employed to define the shape of segmented face electrodes 66. The masking operation enables segment width $w_{Fi}$ to be highly uniform from segment $\mathbf{66}_i$ to segment $\mathbf{66}_i$. The fabrication of spacers 44 typically entail depositing a blanket layer of the material intended to form electrodes 66 and then selectively removing undesired portions of the blanket layer using a mask to define where the undesired material is to be removed. The mask can cover the electrode material that forms electrodes 66 or can be used to define the shape of a patterned lift-off layer which is provided below the blanket electrode-material layer and which is removed to lift off undesired electrode material. Alternatively, electrode 66 can be selectively deposited using a mask, typically referred to as a shadow mask, to prevent the electrode material from accumulating elsewhere.

FIGS. 6*a*–6*d* (collectively "FIG. 6") illustrate how spacers 44 are fabricated using a blanket-deposition/selective-removal technique in which a mask covers the desired electrode material. The starting point for the process of FIG.

6 is a generally flat sheet 100 of spacer material. See FIG. 6*a*. Except for not being cut into main spacer portions 60, sheet 100 contains the material(s) of main spacer portion 60 arranged the same thickness-wise as in main portions 60.

Figure 6A:
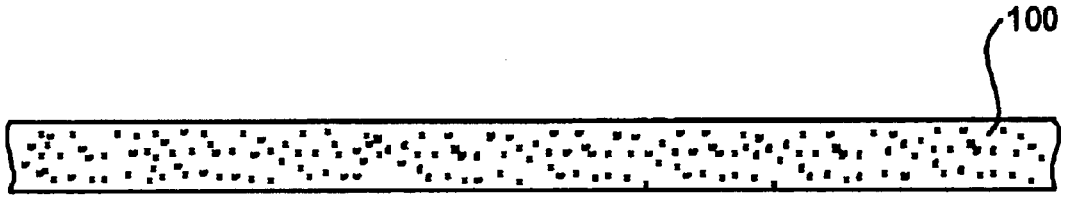
FIGS. 6*a*–6*d* are cross-sectional side views representing steps in a process for manufacturing a spacer suitable for the flat-panel display of FIGS. 3 and 4.
Figure 6B:
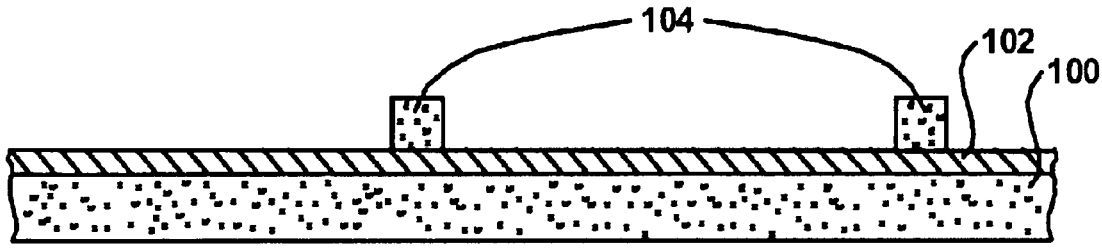
Figure 6C:
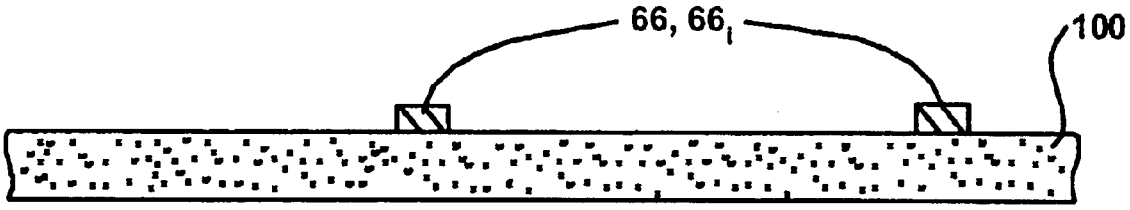

A blanket layer 102 of the material that forms face electrodes 66 is deposited on sheet 100 as shown in FIG. 6*b*. Blanket electrode layer 102 is of approximately the same thickness as electrodes 66. A photoresist mask 104 configured laterally in the shape of at least one electrode 66, typically multiple electrodes 66, is formed on top of electrode layer 102. FIG. 6*b* illustrates the typical situation in which photoresist mask 104 is in the shape of multiple electrodes 66. The exposed portions of electrode layer 102 are removed with a suitable etchant. Photoresist mask 104 is removed. FIG. 6*c* shows the resultant structure in which the remaining portions of electrode layer 102 form multiple face electrodes 66, two of which are depicted.

Sheet 100 is now cut into main spacer portions 60 by a process in which end electrodes 62 and 64 are formed over the backplate-side and faceplate-side ends of each spacer portion 60. See FIG. 6*d*. The fabrication of spacers 44 is complete. Spacers 44 are subsequently inserted between plate structures 40 and 42 during the display assembly process.

In using a lift-off procedure to create face electrode 66, the starting point is the structure of FIG. 6*a*. A blanket lift-off layer is deposited on top of sheet 100. The lift-off layer is patterned in the reverse shape of electrodes 66 by forming a suitable photoresist mask on the lift-off layer, removing the uncovered lift-off material with a suitable etchant, and then removing the mask. A blanket layer of the face-electrode material is deposited on the remaining patterned lift-off layer and on the uncovered material of sheet 100. The lift-off layer is then removed with a suitable etchant, thereby removing the overlying electrode material. The remainder of the electrode material forms face electrodes 66.

Figure 6D:
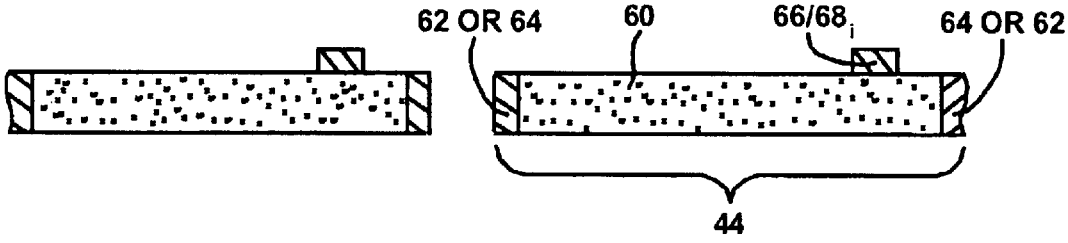

When the shapes of segmented face electrodes 66 are defined by a shadow mask, the starting point for the fabrication process is again the structure of FIG. 6*a*. The shadow mask is positioned above sheet 100 and has openings at the intended locations for electrode 66. The face-electrode material is deposited over the shadow mask and into the openings to produce the structure of FIG. 6*c*. Cutting of sheet 100 and formation of end electrodes 62 and 64 is conducted to produce spacers 44 as shown in FIG. 6D.

Figure 7:
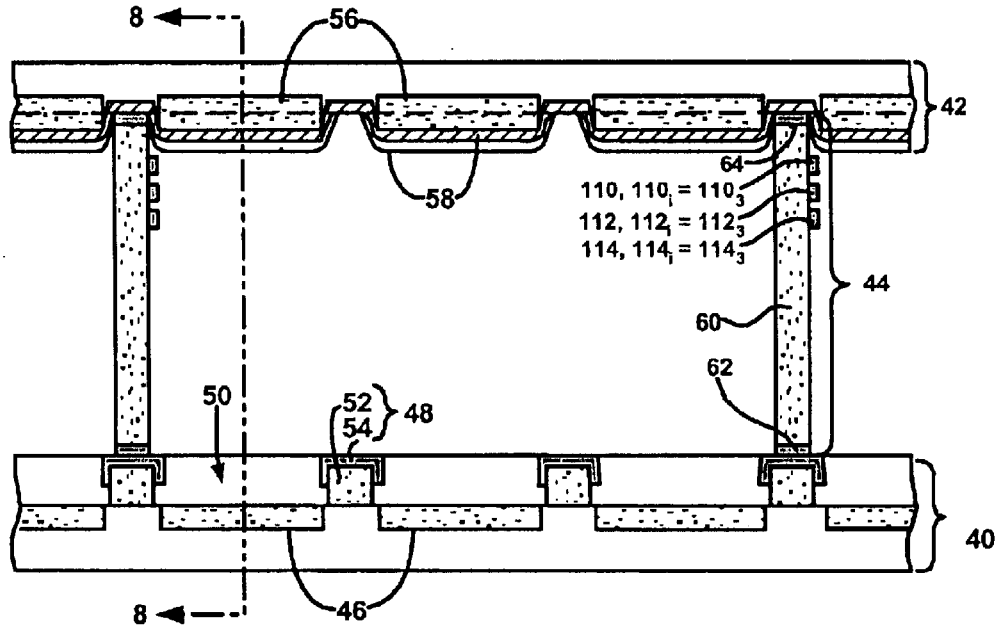
FIGS. 7 and 8 are cross-sectional side views of part of another flat-panel field emission display configured according to the invention. The cross section of FIG. 7 is taken through plane 7—7 in FIG. 8. The cross section of FIG. 8 is taken through plane 8—8 in FIG. 7.
Figure 8:
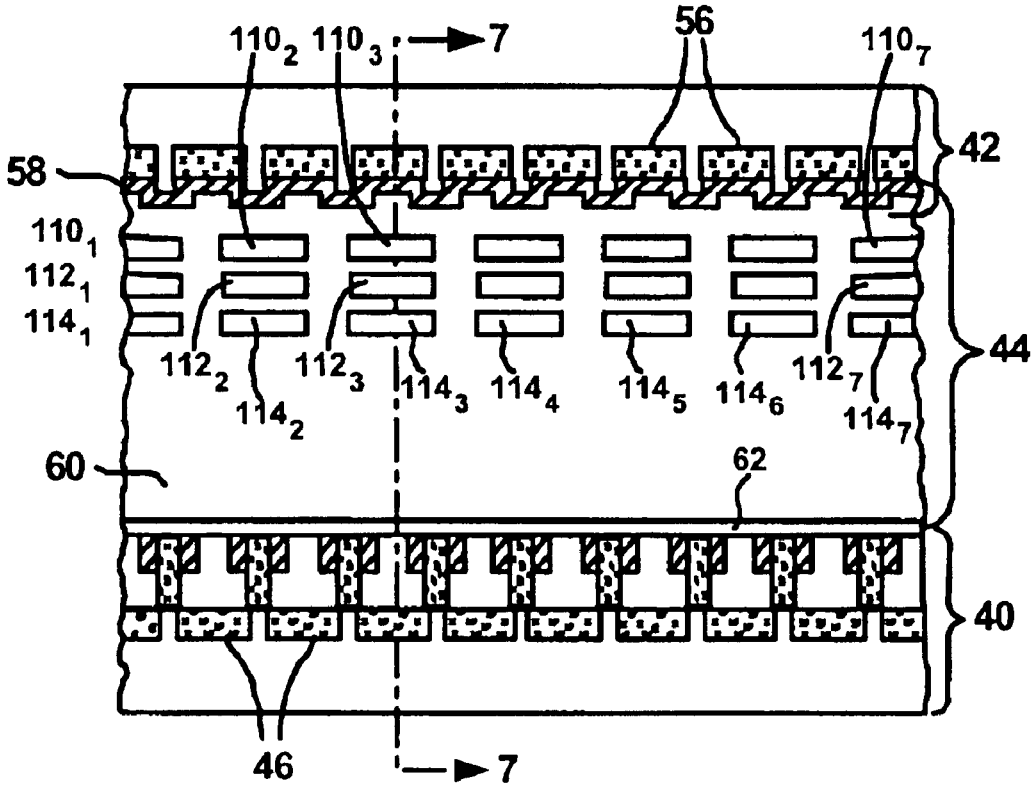

FIGS. 7 and 8, taken perpendicular to each other, illustrate a variation of the flat-panel field emission display of FIGS. 3 and 4 configured according to the invention. Except for the configuration of face electrodes formed on main spacer portions 60 of spacers 44, the flat-panel display of FIGS. 7 and 8 is configured the same as that of FIGS. 3 and 4. Aside from masking modifications needed to account for the different face-electrode configuration, the display of FIGS. 7 and 8 is also fabricated in the same way as that of FIGS. 3 and 4.

In the flat-panel display of FIGS. 7 and 8, multiple laterally segmented electrically conductive face electrodes that extend laterally across the display's active region are situated on one face of main spacer 60 of each spacer portion 44. FIGS. 7 and 8 illustrate an example in which each spacer 60 contains three segmented electrically conductive face electrodes 110, 112, and 114. Each of face electrodes 110, 112, and 114 is located at least approximately a quarter of the way from backplate structure 40 to faceplate structure 42, face electrodes 110 and 114 being respectively closest to and furthest from faceplate structure 42. Electrodes 110, 112, and 114 are normally somewhat closer to faceplate structure 42 than to backplate structure 40. Electrodes 110, 112, and 114 consist of the same material as electrodes 66. The thickness of each of electrodes 110, 112, and 114 is typically the same as that of electrodes 66. Each face electrode 110 is divided into N laterally separated segments $\mathbf{110}_1$, $\mathbf{110}_2$, . . . $\mathbf{110}_N$. Each face electrode 112 is likewise divided into N laterally separated segments $\mathbf{112}_1$, $\mathbf{112}_2$, . . . $\mathbf{112}_N$. Each electrode 114 is also divided into N laterally separated segments $\mathbf{114}_1$, $\mathbf{114}_2$, . . . $\mathbf{114}_N$. FIG. 8 depicts seven segments for each of electrodes 110–112, and 114, N thereby again being at least 7. The lateral separation between electrode segments $\mathbf{101}_1$–$\mathbf{110}_N$, between electrode segments $\mathbf{112}_1$–$\mathbf{112}_N$, and between electrode segments $\mathbf{114}_1$–$\mathbf{114}_N$ is typically the same as the lateral separation between electrode segments $\mathbf{66}_1$–$\mathbf{66}_N$.

Segments $\mathbf{110}_1$–$\mathbf{110}_N$ are all typically of the same size and shape. The same applies to segments $\mathbf{112}_1$–$\mathbf{112}_N$ and segments $\mathbf{114}_1$–$\mathbf{114}_N$. However, the size and shape of the segments in segment groups $\mathbf{110}_1$–$\mathbf{110}_N$, $\mathbf{112}_1$–$\mathbf{112}_N$, and $\mathbf{114}_1$–$\mathbf{114}_N$ can differ from the size and shape of the electrodes in either or both of the other two of segment groups $\mathbf{110}_1$–$\mathbf{110}_N$, $\mathbf{112}_1$–$\mathbf{112}_N$, and $\mathbf{114}_1$–$\mathbf{114}_N$. Although segments $\mathbf{110}_1$–$\mathbf{110}_N$, $\mathbf{112}_1$–$\mathbf{112}_N$, and $\mathbf{114}_1$–$\mathbf{114}_N$ are shown as rectangles in FIG. 8, they can have any of the other shapes mentioned above for electrode segments $\mathbf{66}_1$–$\mathbf{66}_N$.

Each electrode segment $\mathbf{110}_i$ is typically situated fully above electrode segment $\mathbf{112}_i$. In turn, each electrode segment $\mathbf{112}_i$ is typically situated fully above electrode segment $\mathbf{114}_i$, For the rectangular case, the composite width of segments $\mathbf{110}_i$, $\mathbf{112}i$, and $\mathbf{114}_i$ is typically slightly greater than width $w_{Fi}$.

As in the display of FIGS. 3 and 4, the non-matching of the electrical ends of spacers 44 to the electrical ends of plate structures 40 and 42, especially the non-matching of the backplate-side electrical ends of spacers 44 to the electrical end of backplate structure 40, in the display of FIGS. 7 and 8 leads to undesired electron deflection away from the nearest spacers 44. Each set of electrode segments $\mathbf{110}_i$, $\mathbf{112}_i$, and $\mathbf{114}_i$ typically functions in the same way as electrode segment $\mathbf{66}_i$ to cause electrons emitted from nearby electron-emissive regions 46, especially the nearest regions 46, to be deflected towards the closest spacers 44. This compensates for the undesired electron deflection away from the nearest spacers 44.

The width of each electrode segment $\mathbf{110}_i$, $\mathbf{112}_i$, or $\mathbf{114}_i$ invariably differs somewhat from the target (desired) width for that segment $\mathbf{110}_i$, $\mathbf{112}_i$, or $\mathbf{114}_i$. The face-electrode configuration of FIGS. 7 and 8 is particularly useful when there are uncorrelated, i.e., essentially random, errors in the widths of electrode segments $\mathbf{110}_i$, $\mathbf{112}_i$, and $\mathbf{114}_i$. By having multiple segments $\mathbf{110}_i$, $\mathbf{112}_i$, and $\mathbf{114}_i$, the uncorrelated errors tend to average out so that the actual composite width of each group of three segments $\mathbf{110}_i$, $\mathbf{112}_i$, and $\mathbf{114}_i$ is relatively close to the composite target width for that group of three segments $\mathbf{110}_i$, $\mathbf{112}_i$, and $\mathbf{114}_i$.

The errors in the widths of features created by a photolithographic masking in procedure such as either of the blanket-depositions/selective-removal processes described above for manufacturing face electrodes 66 tend to be correlated. That is, when the actual width of one of the features is greater than, or less than, the target width for that feature, the actual width of each other of the features is typically greater than, or less than, the corresponding target width for that other feature by approximately the same amount.

In a variation of the flat-panel field emission display of FIGS. 7 and 8, only two of segmented face electrodes 110, 112, and 114 are present. For example, consider the case in which only segmented electrodes 110 and 114 are present. As in the display of FIGS. 7 and 8, upper segmented electrode 110 in this variation is at least approximately one quarter of the way from backplate structure 40 to faceplate structure 42 and is normally closer to faceplate structure 42 than backplate structure 40. On the other hand, lower segmented electrode 114 in the variation is less than approximately one quarter of the way from faceplate structure 40 to backplate structure 42. Due to this positioning of lower electrode 114, it causes electrons to be deflected away from nearest spacers 44. Upper electrode 110 thus has an additional duty. Besides producing electron deflection towards nearest spacers 44 to compensate for the non-matching of the electrical ends of each spacer 44 to the electrical ends of plate structures 40 and 42, upper electrode 110 provides compensation for the electron deflection away from nearest spacers 44 due to the positioning of lower electrode 114.

The magnitude of the electron deflection away from nearest spacers 44 due to the positioning of lower face electrode 114 is relatively small compared to the electron deflection towards nearest spacers 44 caused by upper face electrode 110. This difference in deflection magnitude is achieved by suitable adjustment of the target widths of electrodes 110 and 114. Importantly, when there are correlated errors in the widths of electrodes 110 and 114, the error in the width of each upper electrode segment $\mathbf{110}_i$ approximately equals the error in the width of lower electrode segment $\mathbf{114}_i$.

These errors approximately cancel so that the difference between the actual width of upper segment $\mathbf{110}_1$ and the actual width of lower segment $\mathbf{114}_i$ is quite close to the difference between the target width of upper segment $\mathbf{110}_i$ and the target width of lower segment $\mathbf{114}_i$. In other words, the actual, difference in face-electrode segment width is quite close to the target difference in the face-electrode segment width even though errors occur in the widths of both segment $\mathbf{110}_i$ and segment $\mathbf{114}_i$. By appropriately choosing the locations and target widths of electrodes 110 and 114 in this variation, excellent compensation for electron deflection is obtained.

The present flat-panel display typically operates in the following manner. With focus coating 54 and anode layer 58 respectively at potentials $V_L$ and $V_H$, a suitable potential difference is applied to a selected one of electron-emissive regions 46 to cause that region 46 to emit electrons. As anode layer 58 attracts the emitted electrons towards faceplate structure 42, focus coating 54 focuses the electrons towards the corresponding one of light-emissive regions 56. The face electrodes, such as segmented electrodes 66, control the electron trajectories in the manner described above. When the electrons reach faceplate structure 42, they pass through anode layer 58 and strike corresponding light-emissive region 56, causing it to emit light visible on the exterior surface of structure 42. Other light-emissive elements 56 are selectively activated in the same way.

Directional terms such at "upper" and "top" have been employed in describing the present invention to establish a frame of reference by which the reader can more easily understand how the various parts of the invention fit together. In actual practice, the components of a flat-panel field emission display may be situated at orientations different from that implied by the directional terms used here. Inasmuch as directional terms are used for convenience to facilitate the description, the invention encompasses implementations in which the orientations differ from those strictly covered by the directional terms employed here.

While the invention has been described with reference to particular embodiments, this description is solely for the purpose of illustration and is not to be construed as limiting the scope of the invention claimed below. For instance, the main portions of the spacers can be formed as posts or as combinations of walls. The cross section of a spacer post, as viewed along the length of the post, can be shaped in various ways such as a circle, an oval, or a rectangle. As viewed along the length of a main spacer portion consisting of a combination of walls, the spacer portion can be shaped as a "T", an "H", or a cross. In these variations, each laterally segmented face electrode formed on a main spacer portion may extend fully or partially around, e.g., halfway or more around but not all the way around, the main spacer portion depending on factors such as the extent to which the segment potentials penetrate laterally through the main spacer portion.

Segmented face electrodes 66 can form parts of spacers configured similar to spacers 44 for causing electrons emitted from nearby electron-emissive regions in a flat-panel field emission display to be deflected toward the spacers in situations where undesired electron deflections away from the spacers are caused by mechanisms other than the backplate-side and faceplate-side electrical ends of the spacers being respectively located above the electrical ends of the backplate and faceplate structures. With each face electrode 66 still typically being closer to the faceplate structure than the backplate structure, the compensatory electron deflections toward the nearest spacers are produced according to the principles described above for face electrodes 66. In this regard, two or more laterally segmented face electrodes, such as face electrodes 110, 112, and 114, may be substituted for each face electrode 66.

On the other hand, as in the above-mentioned variation to the display of FIGS. 7 and 8, laterally segmented face electrodes generally akin to face electrodes 66 can be employed to cause electrons emitted by electron-emissive regions in a spacer-containing flat-panel field emission display to be deflected away from the nearest spacers when other mechanisms cause undesired electron deflections toward the spacers. The undesired deflections away from the nearest spacers can arise for various reasons such as the backplate-side electrical ends of the spacers being located below the electrical end of the backplate structure. In this case, the segmented face electrodes are typically located less than approximately one fourth of the distance from the backplate structure to faceplate structure. The compensatory electron deflections toward the nearest spacers are produced according to the reverse of the principles applied to face electrodes 66. Each such segmented electrode can be replaced with two or more laterally segmented face electrodes.

Other mechanisms for controlling the potential field along spacers 44 may be used in conjunction with segmented face electrodes 66. Electron deflections that occur due to thermal energy (heat) flowing through spacers 44 can be reduced to a very low level by applying the design principles described in Spindt, U.S. patent application Ser. No. 09/032,308, filed Feb. 27, 1998, now U.S. Pat. No. 5,990,614 Externally generated potentials may, in some instances, be applied to certain or all of electrode segments $\mathbf{66}_1$–$\mathbf{66}_N$. In other instances, face electrodes that contact end electrodes 62 or/and end electrodes 64 may be provided on main spacer portions 60.

Conversely, end electrodes 62 or/and end electrodes 64 may sometimes be deleted. In such cases, each face electrode 66 is still spaced apart from the physical ends of its main spacer portion 60, and thus from plate structures 40 and 42. The same applies to face electrodes 110, 112, and 114.

Field emission includes the phenomenon generally termed surface emission. Backplate structure 40 in the present flat-panel field emission display can be replaced with an electron-emitting backplate structure that operates according to thermionic emission or photoemission. While control electrodes are typically used to selectively extract electrons from the electron-emissive elements, the backplate structure can be provided with electrodes that selectively collect electrons from electron-emissive elements which continuously emit electrons during display operation. Various modifications and applications may thus be made by those skilled in the art without departing from the true scope and spirit of the invention as defined in the appended claims.

Figure 9A:
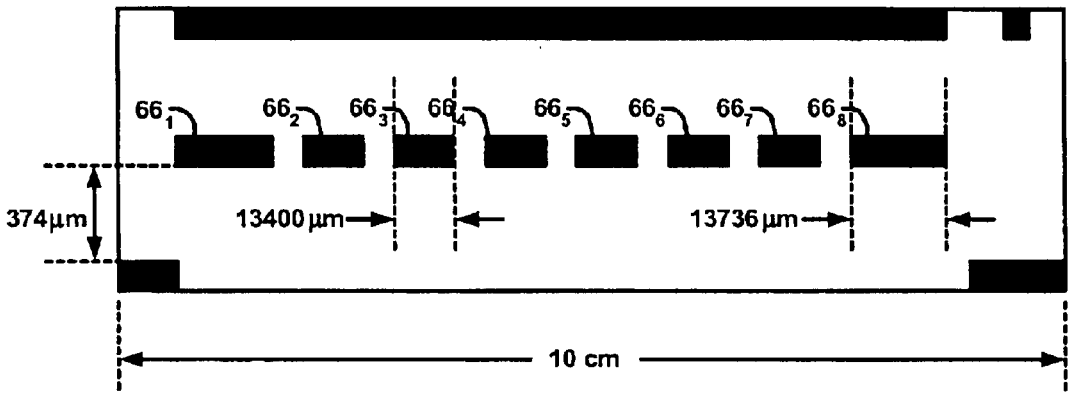
FIGS. 9*a* and 9*b* are cross-sectional side views of a section of segmented electrodes configured with optimal segment lengths, in accordance with one embodiment of the present invention.

With reference to FIG. 9A, a segmented electrode is described with segments lengths defined according to one embodiment of the present invention. Zero current deviations in the wall surface potential due to slightly nonuniform resistivity of the wall are significant enough to cause deflection of an electron beam adjacent to the wall.

For an exemplary Edison beta tube in the present embodiment, the length defined for an electrode segment, to minimize zero current, in accordance with the present embodiment, is on the order of 1 cm. Advantageously, this larger size also allows individual electrode sections to be probed and tested. FIG. 9A depicts an exemplary array of eight segmented electrodes $\mathbf{66}_i$ through $\mathbf{66}_8$ along a wall 60 of a length of 10 cm. In the present embodiment, end segments $\mathbf{66}_i$ and $\mathbf{66}_8$ each have optimal lengths of 1.3736 cm; intermediate (e.g., non-end) segments $\mathbf{66}_2$ through $\mathbf{66}_7$ each have an optimal length of 1.3400 cm.

Figure 9B:
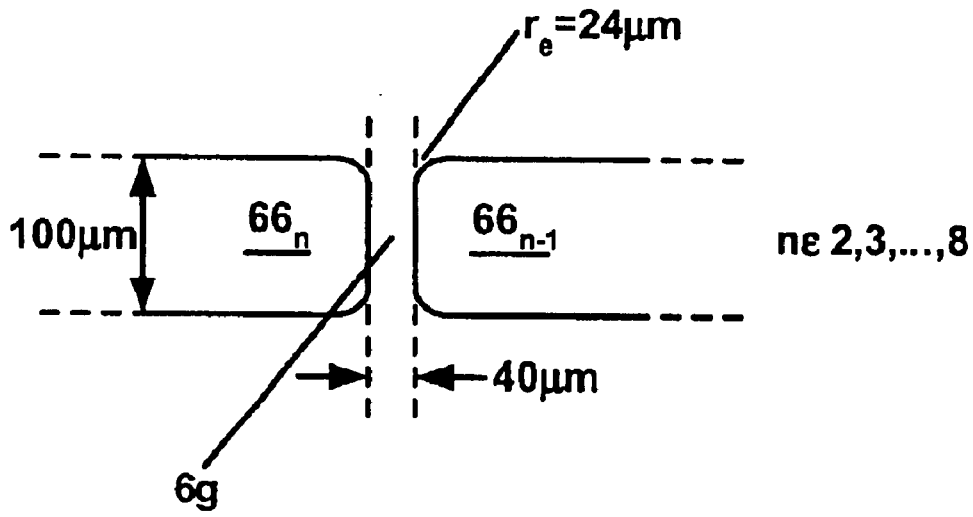

As depicted in FIG. 9B, in the present embodiment, the distance 6*g* between any electrode segment 66*n* and the adjacent electrode segment 66n−1, defined to minimize zero current shift, is 40 $\mu$m. Every corner of each segment $\mathbf{66}_i$ through $\mathbf{66}_8$ is curved to a radius of 24 $\mu$m. Advantageously, curving the segment edges prevents a concentration of electric field lines around the segment ends which could contribute to distortion.

Figure 10:
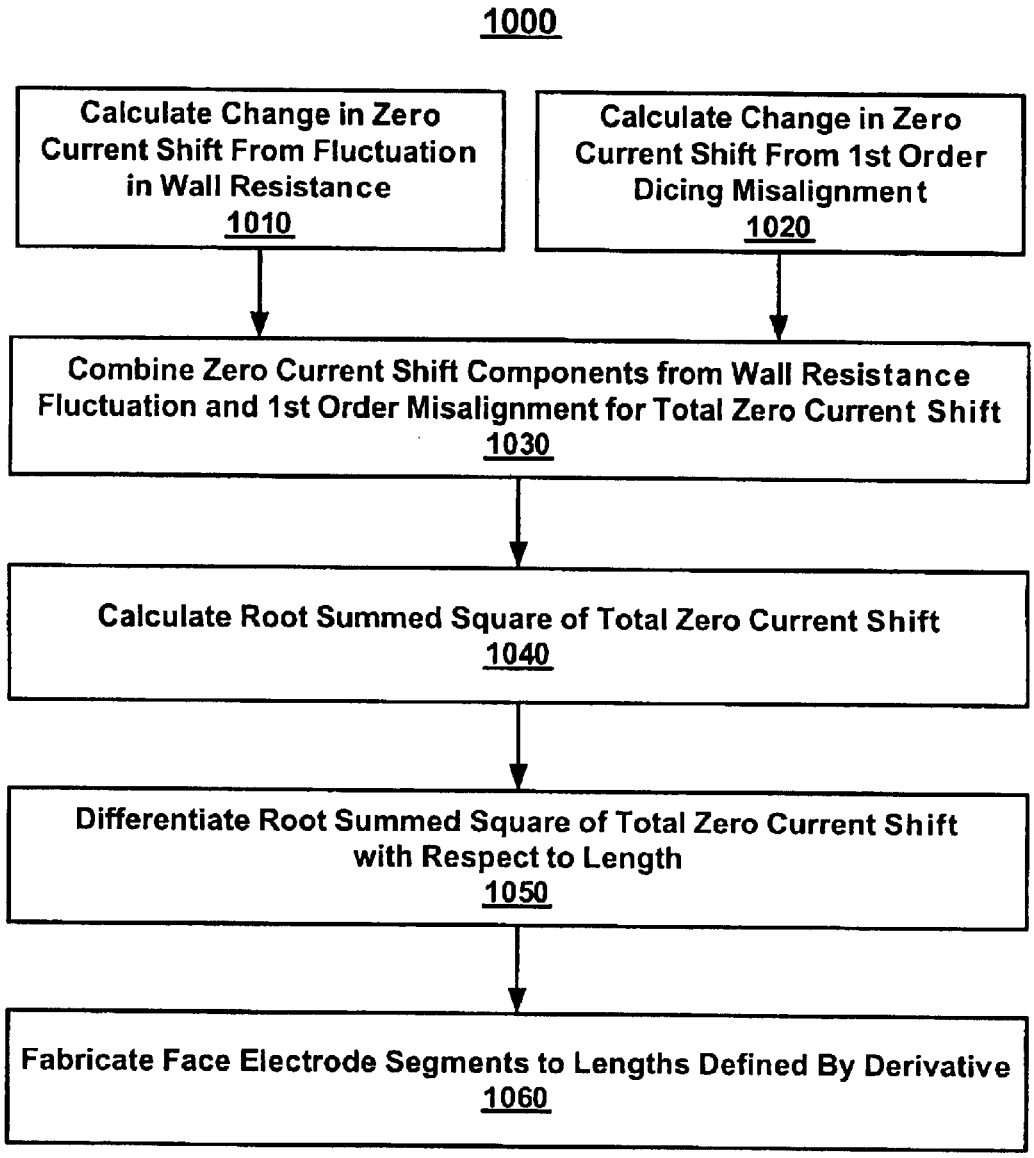
FIG. 10 is a flow chart of the steps in a process for minimizing zero current shift, in accordance with one embodiment of the present invention.

With reference to FIG. 10, the length of the segment lengths effective to minimize zero current shift are defined by a process 1000, in accordance with one embodiment of the present invention.

Along an electrode segment, the wall is forced to the same potential. This averages out resistance variations in the wall material. Zero current shifting variations from wall resistance fluctuations fall off with electrode segment length as $$\Delta ZCS=\alpha\sigma_p(L+L_0)^{-1/2}$$

where ΔZCS is the change in zero current shift from wall resistance fluctuation, α is a first beam deflection sesitivity factor, (e.g., the height of the electrode segment relative to the total wall height), $\sigma_p$ is the nonuniformity of the wall resistance, L is the wall length and $L_0$ is the dimension over which the resistance would naturally average by the current flow, on the order of half the height of the wall. In step 1010, the change in zero current shift due to fluctuation in wall resistance is determined.

Breaking the electrode up into short segments reduces the sensitivity dicing alignment because each segment floats to a potential appropriate to its height up the wall. Zero current shift due to a first order angular misalignment during dicing varies linearly with the length of the electrode segment by $$\Delta ZCS=\beta\delta L$$

where ΔZCS is the change in zero current shift variation, β is a second beam deflection sensitivity factor (e.g., the pixel pitch), δ is a measure of dicing tolerance, and L is the wall length. In step 1020, the change in zero current shift due to first order dicing misalignment is determined.

The change in zero current shift due to fluctuation in wall resistance is combined with the change in zero current shift due to first order dicing misalignment; step 1030.

The root summed square is then taken, in step 1040, to obtain $$\alpha^2\sigma_p^2(L+L_0)^{-1}+\beta^2\delta^2L^2.$$

Differentiating the root summed square of the total zero current shift variation with respect to L, step 1050, defines the electrode segment length $L_{opt}$ for minimal zero current shift as $$L_{opt}=(\alpha^2\sigma_p^2/(2\beta^2\delta^2))^{1/3}.$$

Electrode segments are fabricated accordingly; step 1060.

Figure 11:
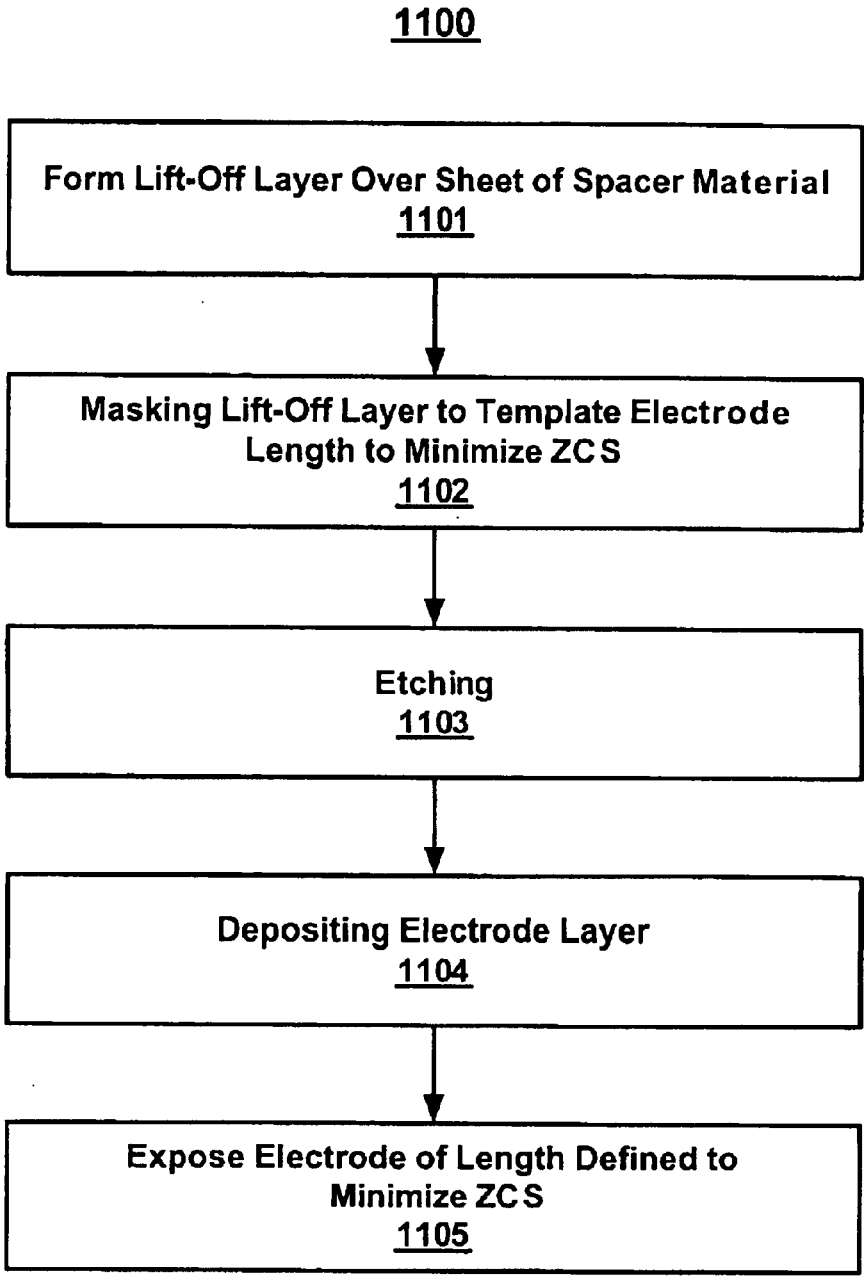
FIG. 11 is a flow chart of the steps in a process for fabricating a flat panel field emission display, which exhibits minimal zero current shift, in accordance with one embodiment of the present invention.

With reference to FIG. 11, the steps in an exemplary process 1100 for fabricating a flat panel field emission display with segmented face electrode segments of lengths defined to minimize zero current shift, in accordance with one embodiment of the present invention, are described. Beginning at step 1110, a lift-off layer is formed over a sheet of spacer material.

The lift-off layer is masked; step 1102. Masking, a photolithographic technique well known in the art, templates the surface whereon the face electrodes are to be deposited. The template designates the contour to which the electrodes will conform. This contour includes the electrodes' length, which is defined to minimize zero current shift.

In step 1103, etching, performed by photolithographic techniques well known in the art, removes material of the lift-off layer not covered by the mask. The mask is then removed.

An electrode layer is then deposited over remaining material of the lift-off layer, exposed by etching and mask removal; step 1104. Electrode material is deposited by metal deposition techniques well known in the art. Such techniques may include, but are not limited to, chemical vapor deposition, electroplating, and electroless plating.

Remaining lift-off layer material is then removed by techniques well known in the art; step 1105. This exposes the electrode segments on the face of the spacers. The length of the electrode segments is defined to minimize zero current shift.

It is appreciated that process 1100 exemplifies one embodiment of the present invention for fabricating a flat panel display with spacers having face electrodes of lengths that minimize zero current shift. However, other fabrication techniques may be applied to accomplish the equivalent effect of exemplary process 1100. Although specific steps are disclosed in flowchart 1100, such steps are exemplary. That is, the present invention is well suited to performing various other steps or variations of the steps recited in FIG. 11.

Various modifications and applications may thus be made by those skilled in the art without departing from the true scope and spirit of the invention as defined in the appended claims.

What is claimed is:

1. A method of forming laterally segmented face electrodes for a flat panel display spacer comprising:

a) defining a length for said electrodes, wherein said length is effective for minimizing zero current shift, wherein said defining a length for said electrodes comprises:

a1) determining a value for change in zero current shift from fluctuation in resistance of said spacer;

a2) determining a value for change in zero current shift from misalignment;

a3) combining said value determined in said a1) and said value determined in said a2) into a total zero current shift value;

a4) taking a root summed square of said total zero current shift value: and a5) differentiating said root summed square of said total zero current value with respect to length to determine the length for minimum zero current shift variation; and b) fabricating said face electrodes of said length.

2. The method as recited in claim 1, wherein said b) further comprises:

b1) forming a liftoff layer over a sheet of material constituting said spacer;

b2) masking said lift-off layer;

b3) removing a portion of said lift-off layer not masked;

b4) removing the mask;

b5) depositing an electrode layer over remaining material of the lift-off layer and over uncovered material of the sheet of spacer material; and b6) removing the remaining material of the lift-off layer to remove overlying material of the electrode layer.

3. The method as recited in claim 2, wherein said b2) further comprises templating to form said electrode segments at said length defined.

4. The method as recited in claim 3, wherein said b6) further comprises exposing said electrodes of said length defined.

5. A method for achieving low zero current shift for flat panel displays having spacers with laterally segmented face electrodes of a plurality of segments, comprising:

a) determining a first component of said zero current shift resulting from a nonuniformity in resistivity of said spacers;

b) determining a second component of said zero current shift resulting from misalignment;

c) combining said first component and said second component into a total zero current shift value;

d) differentiating a derivative of said value with respect to length of said electrodes;

e) defining a length for said electrodes by setting said derivative to zero and solving for length; and f) fabricating each segment of said electrodes accordingly.

6. The method as recited in claim 5, wherein said first component comprises a first product, said first product formed by multiplying first multiplicands.

7. The method as recited in claim 6, wherein said first multiplicands comprise:

a) a first beam sensitivity factor;

b) a value for said nonuniformity of resistivity; and c) a square root of the reciprocal of the sum of the length of said spacer and a dimension over which the resistance would naturally average by current flow.

8. The method as recited in claim 5, wherein said second component comprises a second product, said second product formed by multiplying second multiplicands.

9. The method as recited in claim 8, wherein said second multiplicands comprise:

a) a second beam deflection sensitivity factor;

b) a measure of tolerance of dicing performed in fabricating said spacer; and c) the length of said spacer.

10. A method for achieving low zero current shift for flat panel displays having spacers with laterally segmented face electrodes comprising:

a) determining a first component of said zero current shift resulting from fluctuations in the resistivity of said spacers;

b) determining a second component of said zero current shift resulting from misalignment;

c) combining said first component and said second component into a total zero current shift value;

d) taking a root summed square of said value;

e) differentiating a derivative of said value with respect to length of said electrodes;

f) defining a length for said electrodes, wherein said length comprises a length at which said derivative is zero; and g) fabricating said electrodes according to said length.

11. A method for forming a spacer to comprise a main spacer portion and a face electrode which overlies a face of the main spacer portion and is segmented into a plurality of electrode segments wherein said electrodes are (a) spaced apart from opposite first and second ends of the spacer, (b) spaced apart from one another as viewed generally and (c) of a length effective to minimize zero current shift, comprising:

depositing an electrode layer over a sheet of spacer material; and selectively removing part of the electrode layer to largely form the electrode segments from the remainder of the electrode material; and inserting the spacer between a first plate structure and a second plate structure of a flat-panel display such that the first and second ends of the spacer respectively contact the first and second plate structures, wherein an image is provided on the second plate structure during display operation.

12. The method as recited in claim 11 wherein said second plate structure emits light to produce the image in response to electrons emitted from the first plate structure.

13. The method as recited in claim 11 further comprising cutting the sheet of spacer material to form the main spacer portion.

14. The method as recited in claim 11 wherein said removing comprises using a mask to control where the part of the electrode layer is selectively removed, the remaining electrode segment of a length effective to minimize zero current shift.

15. The method as in claim 14 wherein said removing comprises:

masking over said electrode layer to template an electrode of a length effective to minimize zero current shift; and removing material of said electrode layer not covered by the said mask to form an electrode of a length effective to minimize zero current shift.

16. The method as in claim 14 wherein said removing and depositing comprise:

forming a lift-off layer over said sheets of spacer material;

masking over the lift-off layer with a mask;

removing material of the lift-off layer not covered by the said mask;

removing said mask;

depositing said electrode layer over remaining material of the lift-off layer and over uncovered material of the sheet of spacer material; and removing the remaining material of the said lift-off layer to remove overlying material of said electrode layer to leave an electrode of a length effective to minimize zero current shift.

* * * * *